US011297960B2

(12) United States Patent
Voelker et al.

(10) Patent No.: US 11,297,960 B2
(45) **Date of Patent: *Apr. 12, 2022**

(54) PICTURE FRAME HANGING ASSEMBLY AND METHOD OF INSTALLATION

(71) Applicant: Black Tie Brands, LLC, Aventura, FL (US)

(72) Inventors: Scott Voelker, Aventura, FL (US); Jonathan Batchelor, Aventura, FL (US)

(73) Assignee: BLACK TIE BRANDS, LLC, Miami, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/114,101

(22) Filed: Dec. 7, 2020

(65) Prior Publication Data

US 2021/0085103 A1 Mar. 25, 2021

Related U.S. Application Data

(63) Continuation of application No. 16/051,452, filed on Jul. 31, 2018, now Pat. No. 10,856,675.

(51) Int. Cl.
*A47G 1/16* (2006.01)
*A47G 1/20* (2006.01)

(52) U.S. Cl.
CPC ..... *A47G 1/1613* (2013.01); *A47G 1/162* (2013.01); *A47G 1/20* (2013.01)

(58) Field of Classification Search
USPC ..... 248/690, 692, 301, 304, 305, 306, 339; 40/758, 759
See application file for complete search history.

(56) References Cited

U.S. PATENT DOCUMENTS

| | | | | |
|---|---|---|---|---|
| 3,922,807 | A * | 12/1975 | Shore | A47G 1/0605 40/759 |
| 4,385,744 | A * | 5/1983 | Sherman | A47G 1/1606 248/551 |
| 10,856,675 | B2 * | 12/2020 | Voelker | A47G 1/205 |
| 11,219,321 | B2 * | 1/2022 | Coyle, Jr. | A47G 1/10 |
| 2009/0294610 | A1 * | 12/2009 | Paharik | A47G 1/1606 248/220.21 |

* cited by examiner

*Primary Examiner* — Alfred J Wujciak
(74) *Attorney, Agent, or Firm* — Mark C. Johnson; Johnson Dalal

(57) ABSTRACT

A picture frame hanging assembly that includes at least one bracket directly coupled to either a horizontally oriented or a vertically oriented frame element and each bracket enclosing and defining hook-receiving aperture superimposed over a frame cavity of the picture frame and with an aperture width. The assembly includes a hook component directly coupled to a building wall surface and with a cantilevered hook member extending therefrom an offset length from a front surface of the hook component to define a bracket placement zone with the bracket disposed therein and having an inner surface with an inner surface hook width spanning from terminal opposing lateral sides thereon and at least partially supporting an upper wall of the hook component, wherein the aperture width is at least approximately twice or greater than the inner surface hook width.

15 Claims, 20 Drawing Sheets

PICTURE FRAME HANGING ASSEMBLY AND METHOD OF INSTALLATION

FIELD OF THE INVENTION

The present invention relates generally to frame hanging assemblies and, more particularly, relates to frame hanging assemblies employing the use of a hook-and-bracket assembly and their method of installation or use.

BACKGROUND OF THE INVENTION

Framed pictures, such as paintings or photos, and mirrors, wall accessories, and shelves (for brevity "frames") are traditionally hung on a wall surface by measuring the distance or length of a targeted position for said painting by attaching a string or a wire to two points on a backside of the painting, such that the string is more or less horizontal. The framed pictures can then be hung on a hook attached to a wall. However, this practice has several drawbacks. For example, it is difficult to adjust the location of the painting without moving the hook. Moving the hook usually involves making a new hole for the hook. The person who moves the painting can only hope that the old hole will be covered by the picture in its new position.

Furthermore, the increased use of photographic art, which is a trend in the art world, tends to lead to larger and larger art works being hung on walls. Large frames are heavy and can sometimes not be supported by a single hook. In that case two or more hooks must be used. It is even more difficult to correctly place two hooks. Moreover, the practice to attach the string to two vertical parts of the picture frame leads to a substantial stress on the structure of the picture frame when the artwork is large. A heavy piece of art supported by this system tends to pull the vertical parts of the picture frame towards each other, which causes stress on the joints. The vertical parts can also be subjected by a twisting force if the frame is heavy. These forces may cause the frame to break, which may lead to, for example, damage to the art work if the frame collapses to the floor. Another disadvantage with this practice is that the top of the frame tends to hang out from the wall, forcing the art work to be observed at an angle and creating an unsightly space between the top part of the picture frame and the wall.

Some known frame hanging assemblies enable the angle of the picture frame to be adjusted. However, it is not possible to adjust the horizontal and/or vertical attachment position of the frame on the wall. Said another way, the picture frame must be removed while the user repositions and sets the hooks, thereby generating a more time- and cost-intensive process that also leads to more structural damage on the user's wall. Another known picture frame hanging system provides for adjustment, but it depends on a horizontal wire attached to the picture frame, which results in the above-mentioned stress on the frame. Moreover, this system seems to have a rather delicate design and is not suitable for heavy pieces of art.

Many other known picture frame hanging systems have rather intricate mechanisms which make them expensive to manufacture and timely and complicated to install. Additionally, these known picture frame hanging systems do not provide an efficient and effective means to set, reposition, adjust, and/or remove the frame in a safe and cost- and time-intensive manner. Additionally, the heavier the frame/art, the more difficult it is to move, slide, and/or adjust the art upon the wire, from friction upon the wire or hook touch points. This means the user has to lift up and move art multiple times until correct placement is accomplished. Each lift and move of the frame, especially heavier frames, can problematically cause frame corners and wire mounting hardware to scratch, mark or tear into wall surfaces. Not only can this damage occur on walls, it is often exposed or not hidden by art in its final resting place.

Therefore, a need exists to overcome the problems with the prior art as discussed above.

SUMMARY OF THE INVENTION

The invention provides a picture frame hanging assembly and method of use that overcomes the hereinafore-mentioned disadvantages of the heretofore-known devices and methods of this general type and that can set, reposition, adjust, and/or remove the frame in a safe, efficient, and effective manner without moving wiring attachment points on frame and/or without creating more holes on walls.

With the foregoing and other objects in view, there is provided, in accordance with the invention and in combination with a picture frame having a front surface, a rear surface opposing the front surface, defining an enclosed frame cavity on the rear surface of the picture frame, having horizontally oriented frame elements opposing one another, and having vertically oriented frame elements opposing one another and each respectively separating the horizontally oriented frame elements, an improvement that includes at least one bracket directly coupled to at least one of the horizontally and vertically oriented frame elements and enclosing and defining, with two internal sidewalls, an upper wall linearly extending to and from the two internal sidewalls, and an internal bottom wall, a hook-receiving aperture superimposed over the frame cavity and with an aperture width separating the two internal sidewalls. Additionally, the improvement includes at least one hook component having a rear surface directly coupled to a building wall surface and a front surface, opposing the rear surface of the hook component, with a cantilevered hook member extending therefrom an offset length from the front surface of the hook component to define a bracket placement zone with the at least one bracket disposed therein and having an inner surface, an inner surface hook width spanning from terminal opposing lateral sides of the hook member, at least partially supporting the linear upper wall of the at least one bracket, the aperture width at least approximately twice or greater than the inner surface hook width and with the cantilevered hook member disposed through the hook-receiving aperture, thereby providing lateral adjustment of the picture frame.

In accordance with another feature, an embodiment of the present invention includes the picture frame including two opposing upper corner joints defined by one of the horizontally oriented frame elements and one of the vertically oriented frame elements, wherein the least one bracket is interposed medially between the two opposing upper corner joints.

In accordance with a further feature of the present invention, the pair of brackets and hook components are of a plate-like shape and substantially rigid.

In accordance with yet another feature of the present invention, the least one bracket and the least one hook component are of a plate-like shape and substantially rigid.

In accordance with an additional feature of the present invention, the hook-receiving aperture is elongated in the transverse direction.

In accordance with a further feature of the present invention, the cantilevered hook member is at least partially disposed within the enclosed frame cavity.

In accordance with another feature, an embodiment of the present invention includes the at least one hook component having an upper end and a lower end opposing the upper end, wherein a terminal end of the hook member of each of the hook components is disposed proximal to the upper end of the hook component.

In accordance with yet another feature, an embodiment of the present invention also includes the horizontally oriented and vertically oriented frame elements collectively defining a picture frame perimeter that defines a frame area, wherein the at least one bracket and the at least one hook component are completely disposed within the frame area.

In accordance with a further feature of the present invention, the at least one bracket has a rear surface, a front surface opposing the rear surface, and also includes a puncturing member coupled thereto and with a tapered end operably configured to protrude outwardly from the rear surface of the at least one bracket.

In accordance with an exemplary feature of the present invention, the at least one hook component also includes a puncturing member aperture aligned with and shaped and sized to receive the tapered end of the puncturing member.

In accordance with a further feature of the present invention, the at least one bracket includes a tab rotatably coupled thereto and having the puncturing member coupled thereto.

In accordance with an additional feature of the present invention, the at least one bracket has a plurality of fastening apertures spaced apart from one another and disposed proximal to a perimeter edge.

Also in accordance with present invention and in combination with a picture frame having a front surface, a rear surface opposing the front surface, defining an enclosed frame cavity on the rear surface of the picture frame, having horizontally oriented frame elements opposing one another, having vertically oriented frame elements opposing one another and each respectively separating the horizontally oriented frame elements, and having two opposing upper corner joints and two opposing lower corner joints defined by one of the horizontally oriented frame elements and one of the vertically oriented frame elements, an improvement that includes at least one bracket interposed between either the two opposing upper corner joints and directly coupled to at least one of the horizontally and vertically oriented frame elements or interposed between one of the two opposing upper corner joints and one of the two opposing lower corner joints and directly coupled to one of the vertically oriented frame elements, and enclosing and defining a hook-receiving aperture superimposed over the frame cavity and with an aperture width. The invention also includes at least one hook component having a rear surface directly coupled to a building wall surface and a front surface, opposing the rear surface of the hook component, with a cantilevered hook member extending therefrom an offset length from the front surface of the hook component to define a bracket placement zone with the at least one bracket disposed therein and having an inner surface, with an inner surface hook width spanning from terminal opposing lateral sides of the hook member, at least partially supporting an upper wall of the at least one bracket, the aperture width at least approximately twice or greater than the inner surface hook width.

In accordance with an additional feature of the present invention, the at least one bracket is interposed medially between either the two opposing upper corner joints or between the one of the two opposing upper corner joints and the one of the two opposing lower corner joints.

Also in accordance and in combination with a picture frame having a front surface, a rear surface opposing the front surface, defining an enclosed frame cavity on the rear surface of the picture frame, having horizontally oriented frame elements opposing one another, and having vertically oriented frame elements opposing one another and each respectively separating the horizontally oriented frame elements, an improvement is disclosed that includes at least one bracket directly coupled to at least one of the horizontally and vertically oriented frame elements, having a rear surface, having a front surface opposing the rear surface of the at least one bracket, a hook-receiving aperture superimposed over the frame cavity and with an aperture width separating the two internal sidewalls, and having a puncturing member coupled thereto and with a tapered end operably configured to protrude outwardly from the rear surface of the at least one bracket. Further, the invention includes at least one hook component having a rear surface directly coupled to a building wall surface, a front surface, opposing the rear surface of the hook component, defining a puncturing member aperture aligned with and shaped and sized to receive the tapered end of the puncturing member, and having a cantilevered hook member extending therefrom an offset length from the front surface of the at least one hook component to define a bracket placement zone with the at least one bracket disposed therein and having an inner surface, an inner surface hook width spanning from terminal opposing lateral sides of the hook member, at least partially supporting the linear upper wall of the at least one bracket, wherein the cantilevered hook member is disposed through the hook-receiving aperture.

Although the invention is illustrated and described herein as embodied in a picture frame hanging assembly and method of use, it is, nevertheless, not intended to be limited to the details shown because various modifications and structural changes may be made therein without departing from the spirit of the invention and within the scope and range of equivalents of the claims. For example, while the present invention is particularly beneficial when hanging picture frames, it may also be implemented with other structures and in circumstances and environments, e.g., mirrors, shelves, etc. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of the hook member of the hook component, while the term "transverse" should be generally understood to mean the direction opposite the longitudinal direction.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

FIG. 4*b* depicts the hook components when they have been vertically adjusted after initial placement;

DETAILED DESCRIPTION

Figure 1:
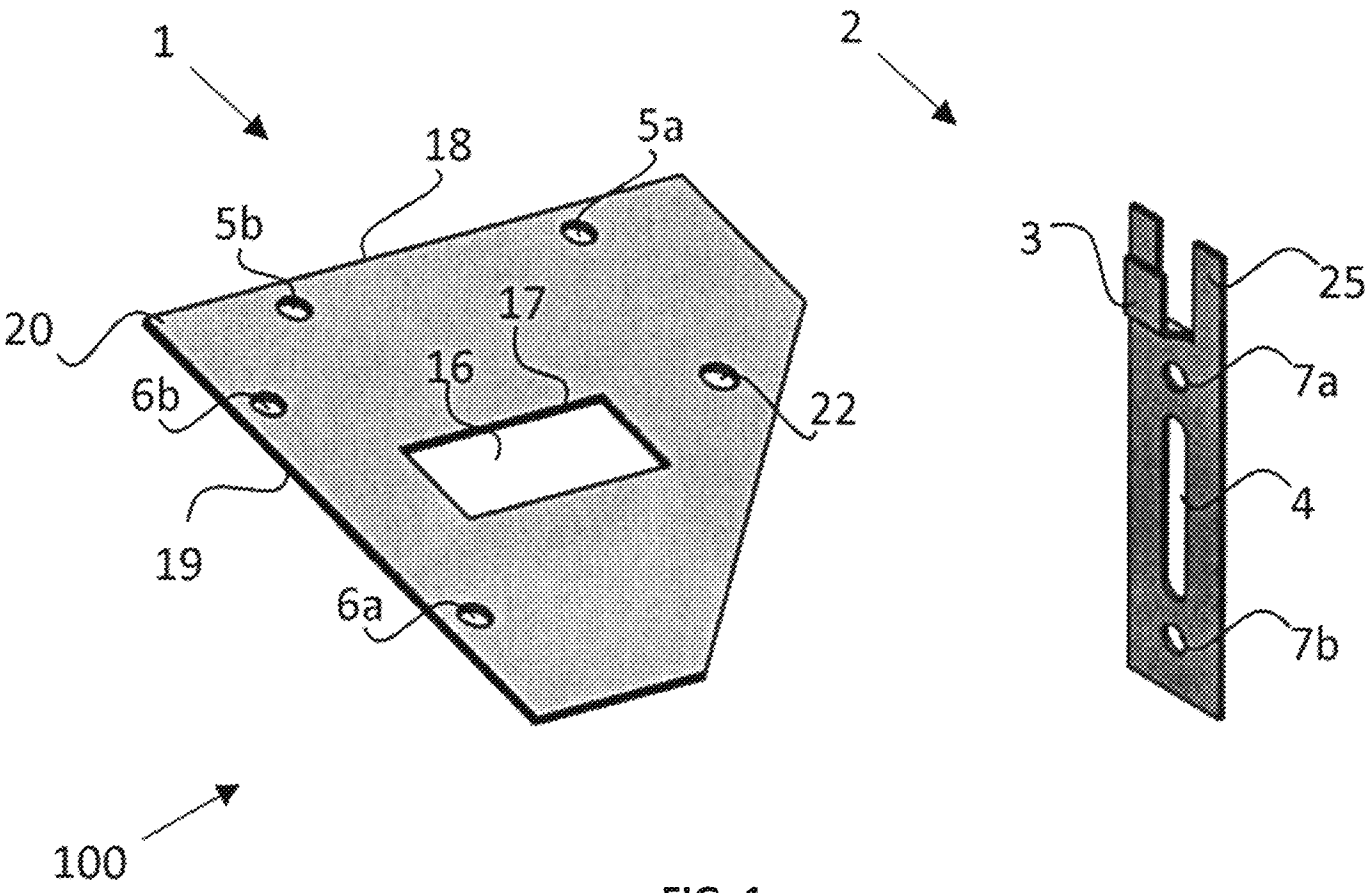
FIG. 1 depicts a bracket and hook component employed with the picture frame hanging assembly in accordance with one embodiment of the present invention.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

The present invention provides a novel and efficient picture frame hanging assembly and method of use. Referring now to FIGS. 1-3*b*, one embodiment of the present invention is shown in perspective views. The figures shows several advantageous features of the present invention, but, as will be described below, the invention can be provided in several shapes, sizes, combinations of features and components, and varying numbers and functions of the components. The first example of a picture frame hanging assembly 100, as shown in FIG. 1, includes bracket 1 and hook component 2. The hook component 2 comprises a hook portion 3, a frame contacting portion 25, and defines a slide aperture 4 permitting vertical adjustment of the hook component 2. The frame contacting portion 25 enables the coupling of the hook component 2 on a building wall surface W. The hook element or member 2 is to be mounted so that the hook 3 projects upwards and outwards from the building wall surface W.

The slide aperture 4 can be, for example, sized and shaped to receive one or more fastener(s) that will fasten and retain the hook component 2 to the wall W. The slide aperture 4 may be elongated into the longitudinal direction and may also be shaped and sized not to permit entry of the head of the one or more fastener(s) inserted into the aperture 4. Other types of attachment means are possible and contemplated, however. The slide aperture 4 may be such that it allows provisional attachment of the hook element 2 during adjustment of the picture frame.

In one embodiment, the slide aperture 4 of the hook element 2 may also be, for example, a rail with an adhesive that can be attached to the wall. Along the rails it is possible to slide a hook that can be fastened at various detent positions. The detent positions are strong enough to hold the picture frame 8 in a provisional manner. The hook 3 can be permanently fastened to the wall with for example screws. The hook element 2 may have further attachment means 7*a*, 7*b* that do not enable vertical adjustability of the hook component 2 and that can be engaged when the correct vertical position of the hook elements 3 is found. Non-vertically adjustable attachment means 7*a*, 7*b* may be holes for screws, or similar fasteners. In one embodiment, the non-vertically attachment means are holes for nails, for example, four holes. Holes for nails are typically made smaller than the holes for screws. The hook element may have both holes for screws and nails so that the user can select which one to use.

Figure 2:
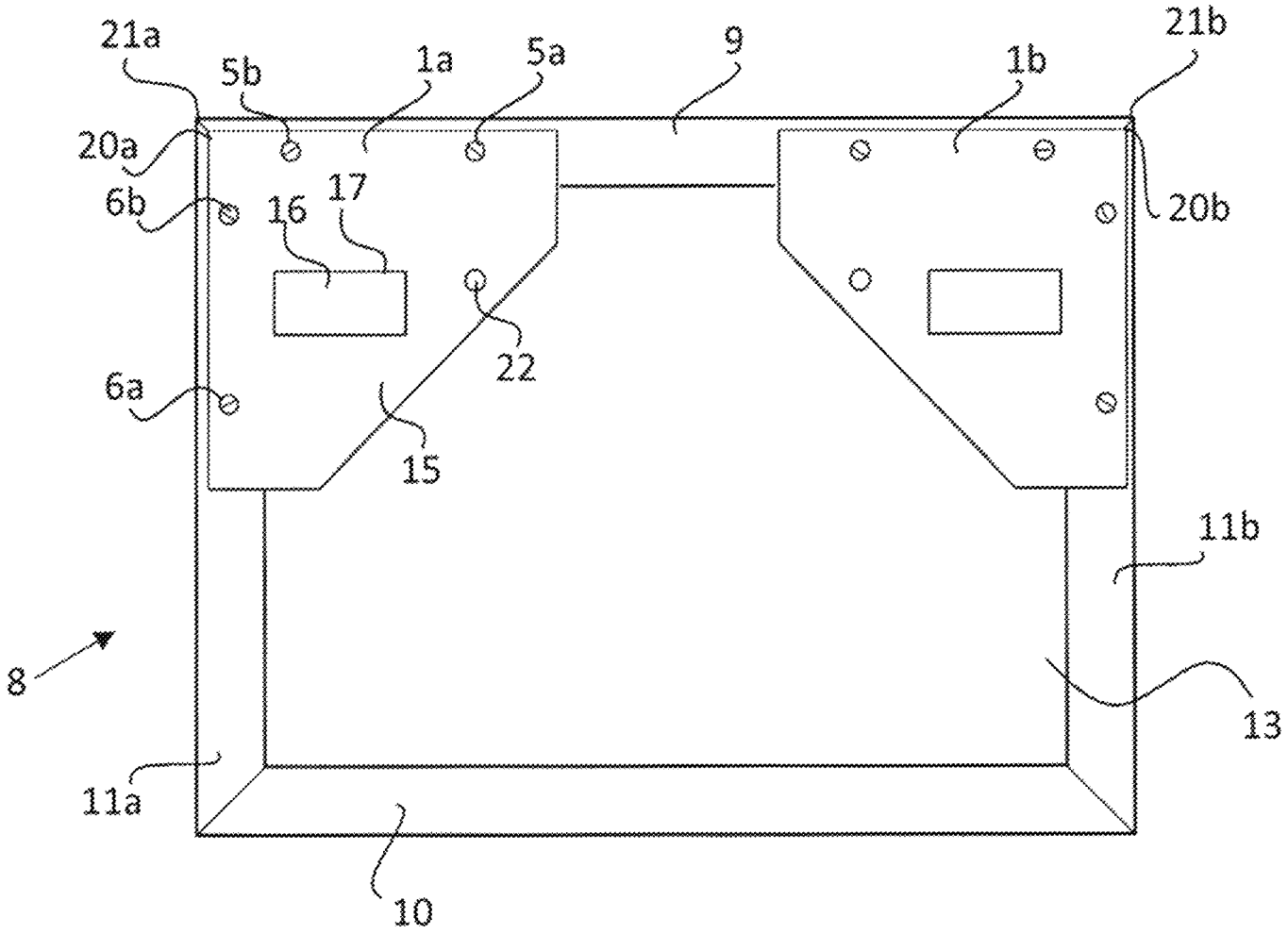
FIG. 2 depicts a back side of a picture frame with two of the brackets of FIG. 1 attached thereto in accordance with one embodiment of the present invention.
Figure 3B:
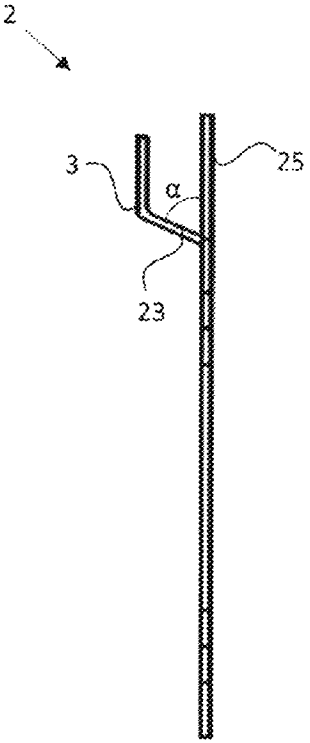
FIG. 3*b* is a side view of a hook element.
Figure 3A:
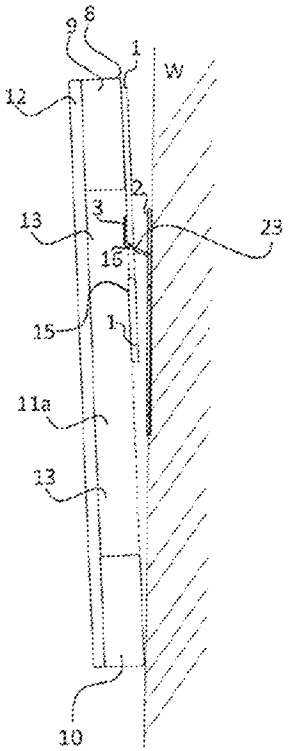
FIG. 3*a* depicts a section of the picture frame in FIG. 2 with the bracket and hook component coupled to a wall. Screws or other fasteners that attach the bracket to the picture frame or that attach the hook to the wall are not shown.

In one embodiment, a pair of brackets 1*a*, 1*b* are employed and may be attached to the back side of a picture frame 8 as shown in FIG. 2. As those of skill in the art will appreciate, the picture frame 8, may generally include two horizontal frame elements having one upper horizontal frame element 9 and one lower horizontal frame element 10 and two vertical frame elements 11*a*, 11*b*. The picture and the glass 12 (FIG. 3*a*) are located such that there is a frame space 13 between the frame elements 9, 10, 11*a*, 11*b*. Referring both to FIGS. 2 and 3*a-b*, a bracket 1 may also include one or more apertures 5, 6 shaped and sized to receive one or more corresponding fastening means 5, 6 for attaching the bracket 1 to the back side of the picture frame 8. As such, the bracket 1 may be attached to at least both the upper horizontal frame element 9 and one vertical frame element 11*a* or 11*b*. Such attachment distributes the hanging forces to the frame 8 in a suitable manner, and also reinforces the picture frame 8. The fastener(s) inserted in the apertures(s) of the bracket 1 may be screws, nails, or other fastening means, such as one or more strip(s) of adhesive tape. Alternately, the bracket 1 may come with preformed nails, such that the bracket 1 can be hammered to the back side of the picture frame 8. In one embodiment there is a first fastening means 5 being located on the bracket 1 so that the attachment means 5 attach the bracket 1 to the back of an upper horizontal frame element 9 of the picture frame 8, and a second attachment site 6 being located on the bracket 1 so that it attaches to the back of a vertical frame elements 11*a*, 11*b*, of the picture frame 8. FIGS. 1-2 depict four fastening means, 5*a*, 5*b*, 6*a*, 6*b*.

Figure 14:
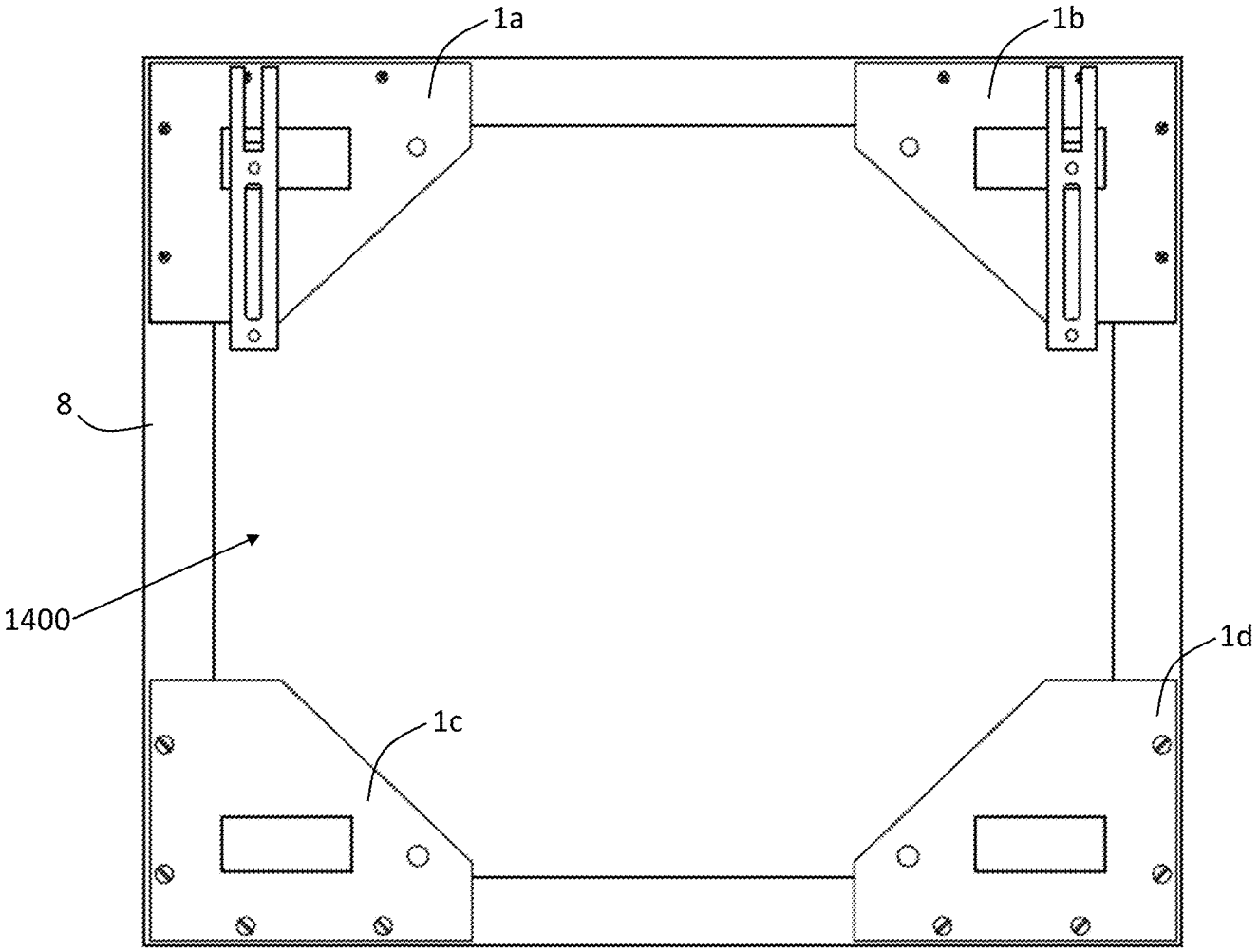
FIG. 14 depicts a back side of a picture frame with the bracket/hook configuration coupled thereto.
Figure 15:
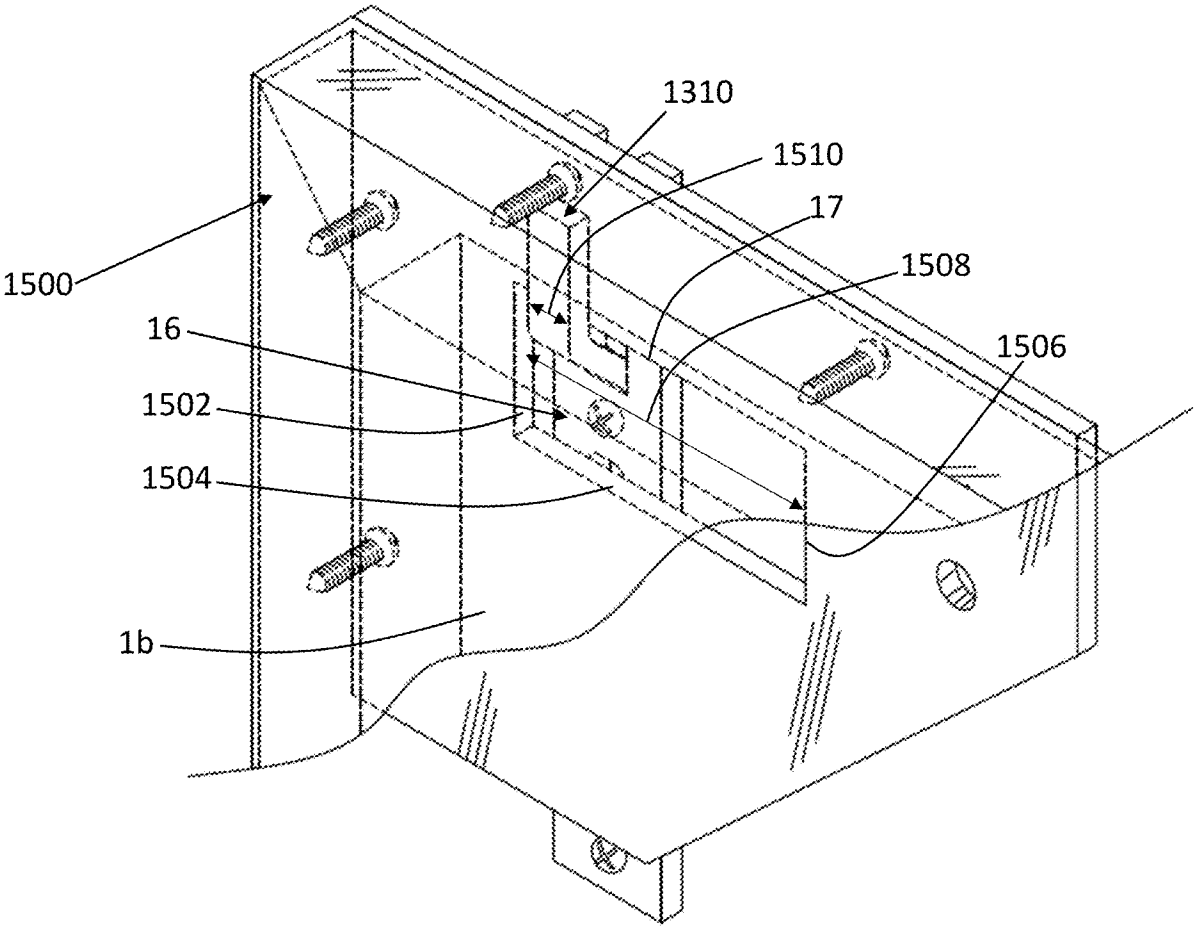
FIG. 15 depicts fragmentary close-up and partially transparent view of a portion of the frame with the bracket/hook configuration coupled thereto.

With reference to FIGS. 1-3 in connection with FIGS. 14-15 the combination of the bracket and hook component assembly can be seen with the picture frame 8. Specifically, the frame 8 includes a front surface 1500 where a picture or other visual indicia may be depicted. The frame 8 includes a rear surface 1400 opposing the front surface 1500, wherein the frame 8 may define the enclosed frame cavity 13 on the rear surface 1400 of the picture frame 8. Beneficially, one or more specially designed brackets 1*a-n* may be utilized to support frame in combination with one or more hook 2*a-n* components, wherein "n" represents any number greater than 1. The brackets 1*a-d* may each be directly coupled to one or more of the frame elements 9-11*a-b*. As seen in FIG. 14, a bracket is coupled to a vertically oriented and a horizontally oriented frame element and disposed proximal to (i.e., at or approximately 2-3 inches near) to each corner joint defined by one of the horizontally oriented frame elements and one of the vertically oriented frame elements. In some embodiments, only two brackets are disposed at the upper corner joint of the frames (as best seen in FIG. 2).

The bracket(s) 1*a-d* can attach to the back side of the picture frame 8 so that it is essentially invisible or concealed from the front of the picture frame 8. Thus, the bracket(s) 1*a-d* preferably do not have any parts that protrude from the back side of the picture frame 8. However, in some embodiments, the edge of the bracket(s) 1 can be seen when the picture frame 8 is observed from the side. At least a part of the bracket 1 covers the space 13. This part of the bracket 1 is referred to as the space-covering part 15.

Advantageously, with reference to FIGS. 1-3*a-b*, the space-covering part 15 of bracket 1 defines and encloses a hook-receiving aperture 16 for receiving the hook member 3 of the hook component 2. The location of the aperture or opening 16 allows the hook 3 to protrude into the space 13 without damaging the picture 12. The opening 16 has a horizontal upper edge or wall 17 for receiving the lower part or inner surface 23 of the hook 3, such that the upper edge or wall 17 rests on the lower part or surface 23 of the hook 3. The opening 16 may have any suitable shape having a horizontal upper edge or wall 17. With brief reference to FIG. 15, the bracket may also include other edges or walls 1502, 1504, 1506, 17 defining the opening 16. The opening 16 may, for example, be a horizontal slot and/or elongated in the transverse direction as shown best in FIG. 2.

Figure 30:
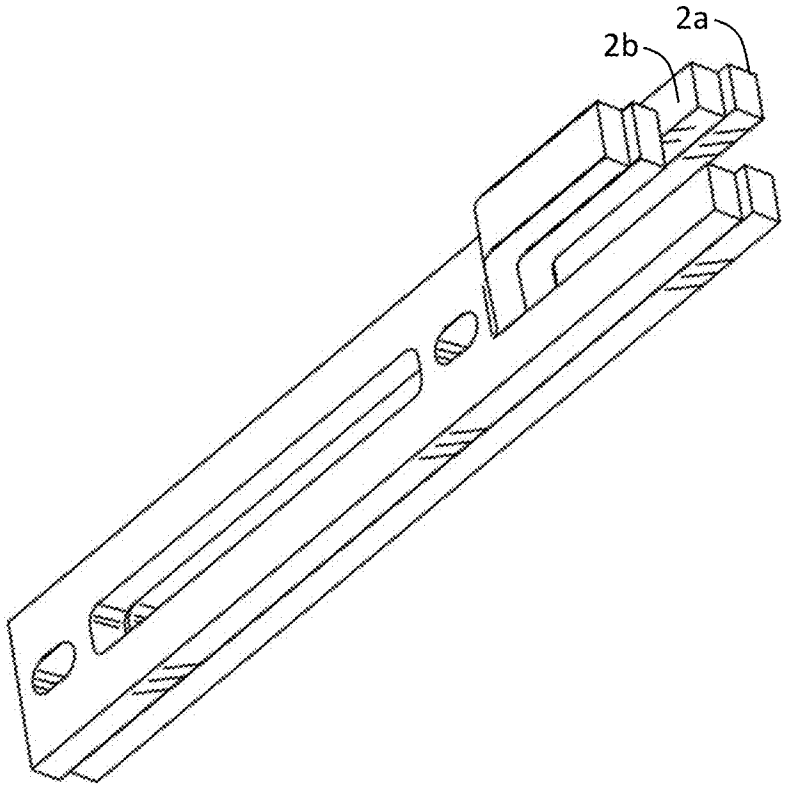
FIG. 30 depicts a perspective view of a hook component configuration in accordance with one embodiment of the present invention.

With reference to FIGS. 2-3*a-b* and FIGS. 15-16, as discussed herein, the bracket(s) 1*a-d* define and enclose the hook-receiving aperture 16 superimposed over the frame cavity 13 and with an aperture width 1508. The openings 16 on the bracket(s) 1*a-d* are shaped and sized to receive a hook member 3 on a hook component 2, wherein the hook member 3 may span outwardly and upwardly away in longitudinal direction toward the upper end 1608 of the hook component 2 from the front surface 1600 of the hook component 2. Said another way, the hook member 3 may be of a multi-directional and sectioned member to securely retain and/or support, with the portion(s) 1602, 1604, the upper portion 1612 of the bracket 1. In one embodiment, there is one hook component 2 for each bracket 1. In some embodiments, there may be two superimposed hook components 2 to create a support surface operable to support heaver frame weights (as best seen in FIG. 30). In preferred embodiment, when the hook member 2 is inserted through the hook-receiving aperture 16, it is at least partially disposed within the enclosed frame cavity 13 (as best seen in FIG. 15).

Referring to FIG. 1, FIGS. 3*a-b*, and FIGS. 12-16, should the frame 8 have two brackets 1*a-b* disposed proximal to, for example, the upper corner joints of the frame 8, the frame hanging assembly 100 may include a pair of hook components 2 each respectively having a rear surface 1300 directly coupled to a building wall surface W. The hook components 2 also have a front surface 1600 opposing the rear surface 1300 of the hook component 2, with a cantilevered hook member 3 extending therefrom an offset length, e.g., length 1302, from the front surface 1600 to define a bracket placement zone 1304. As such, a bracket 1 is sized and shaped to be disposed within the bracket placement zone 1304. Said another way, the bracket placement zone 1304 may be sized and shaped to receive the thickness of the bracket 1. Additionally, the hook member 3 includes an inner surface 1306 with an inner surface hook width 1510 spanning from terminal opposing lateral sides 1200, 1202 of the hook member 3.

In one embodiment, the hook width 1510 is approximately 0.25-3 inches and may continually and/or uniformly maintain said width from the point 1308 at which it extends from the front surface 1600 to the terminal end 1310 of the hook member 3. The inner surface 1306 of the hook member 3 at least partially supports an upper wall 17 of the bracket 1, i.e., in some embodiments, the upper portions 1602, 1604 of the hook component 2 may facilitate in retaining and/or supporting the bracket 1 when inserted within the bracket placement zone 1304. As best seen in FIG. 15, the aperture width 1508 is at least approximately twice or greater than the inner surface hook width 1510, thereby providing horizontal or lateral adjustment of the picture frame 8. In one embodiment, the aperture width 1508 may be approximately 1-4 inches, thereby providing a translation distance of approximately 1.5×-3× the hook width 1510 for movement of the hook member.

With reference back to FIGS. 1-2, the bracket 1 may include one or more attachment apertures or sites 5*a-b*, 6*a-b* for attaching the bracket 1 to the back of a vertical frame element 11*a*, 11*b* of the picture frame 8. The apertures 6*a-b* may be located above, below, or above and below the horizontal upper edge 17 of the opening 16, as in the case of attachment site 6*a-b*. The bracket 1 can have any suitable shape. Thus, it may for example be rectangular, circular or triangular. Suitable dimensions of the bracket 1 can be from approximately 2.5×2.5 inches to 6×6 inches when it is rectangular or triangular. A suitable length of the upper edge 17 of the opening 16 can be from 1-3 inches.

The bracket 1 may have an upper edge 18 and a side edge 19, said upper edge 18 and said side edge 19 meeting at a corner 20 for attachment to a corner joint 21 of a back side of the picture frame 8. The angle of upper edge 18 in relation to side edge 19 may be from 80°-110°, but is more preferably from 85°-100°, namely 90°. The corner 20 of the bracket 1 may be of a 90° orientation, but may have other shapes or angles, such as rounded, oblong, pointed, etc. The bracket 1 can be attached to picture frame 8 such that the corner 20 is roughly aligned with the corner 21 of the picture frame 8. FIG. 2 depicts two brackets 1*a* and 1*b* attached so that their respective corners 20*a*, 20*b* are aligned with the upper corners 21*a*, 21*b* of the picture frame 8.

Figure 16:
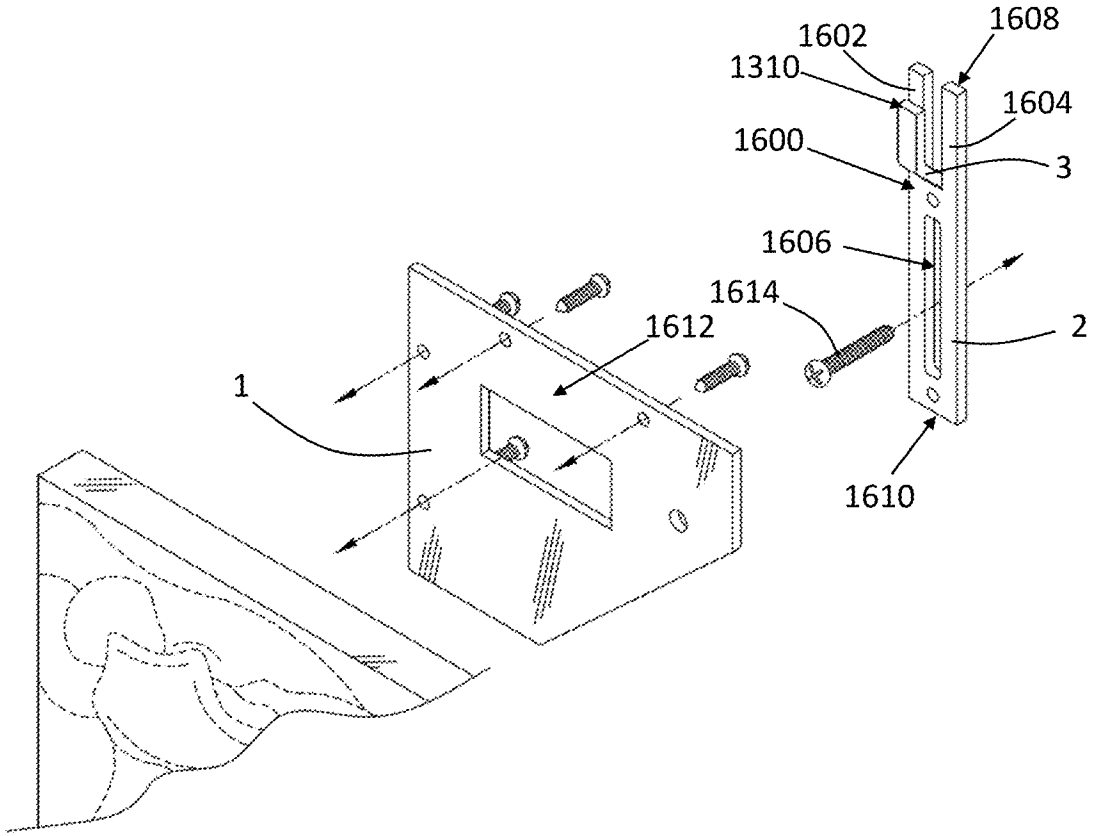
FIG. 16 depicts an exploded view of a portion of the frame with the bracket/hook configuration.

With reference to FIG. 1 and FIG. 16, the hook component 2 may also beneficially include a vertically adjustable aperture 4 or puncturing member aperture 1606 sized and shaped to receive one or more fasteners, e.g., fastener 1614, to retain the hook component 2 to the building wall surface W. The aperture 4, 1606 may be vertically elongated in the longitudinal direction a length of approximately 0.7-2 inches, i.e., from an upper position to a lower position. Preferably, the longitudinal range of vertical adjustability may be approximately 0.9-1.4 inches.

The bracket 1 and the hook component 2 can be made of sheet metal generally regarded as substantially rigid and plate-like in shape. Said another way, the bracket 1 and hook component 2 may be of sheet metal or other substantially rigid material, e.g., PVC plastic, having an average thickness from approximately 0.2-0.5 inches. The bracket 1 and hook component 2 may be plate-like so that they are easy to conceal behind the frame 8 when coupled to the wall surface W. Additionally, said components are also easier to manufacture and effectuate easier bending, concealment, and/or forming the constituent parts/members thereon, e.g., the hook member 3 on the hook component 2. Specifically, the hook component(s) 2 include an upper end 1608 and a lower end 1610 opposing the upper end 1608, wherein the terminal end 1310 of the hook member 3 of each of the hook components 3 is disposed proximal to the upper end 1608 of the hook component 2. Said differently, the upper end 1608 may be defined by one or both of the upper portions 1602, 1604 may be substantially coplanar (within approximately 0.2-0.5 inches) with the terminal end 1310 of the hook member 2. In one embodiment, one or more bracket(s) 1 and hook component(s) 2 are completely disposed within a frame area defined by a perimeter of the horizontally and vertically oriented frame elements.

The bracket 1 may be reversible such that it can be attached to either the upper left corner 21*a* or the upper right corner 21*b* of the picture frame 8. The bracket shown in FIGS. 1-2 is reversible. Two brackets 1 and two hook elements 2 can be provided as a kit, for hanging one picture frame 8 on a wall. FIG. 3*a* shows how the upper horizontal part 9 of the frame 8 is at a distance from the wall W. This may be undesirable and prevented by having the hook element 3 slanting upwards from the wall. This makes the picture frame 8 "slide" down towards the wall, so that it hangs more or less parallel to the wall. Thus, the angle $\alpha$ between the lower part 23 of the hook 3 and the wall contacting part 25 may be less than 90°, preferably from 50°-80°, more preferably from 55° to 70°.

A method for installing or hanging the picture frame 8 on a wall surface using two hook components 2 and two brackets 1*a-b*, as described above, is depicted in FIG. 5. Initially, the process may include providing a picture frame having a front surface, a rear surface opposing the front surface, defining an enclosed frame cavity on the rear surface of the picture frame, and having horizontally and vertically oriented frame elements as described above. Thereafter, in step 100, may include attaching a first bracket to at least one of the horizontally and vertically oriented frame elements and a second bracket to at least one of the horizontally and vertically oriented frame elements, wherein the first and second brackets each enclose and define the hook-receiving aperture superimposed over the frame cavity.

Figure 13:
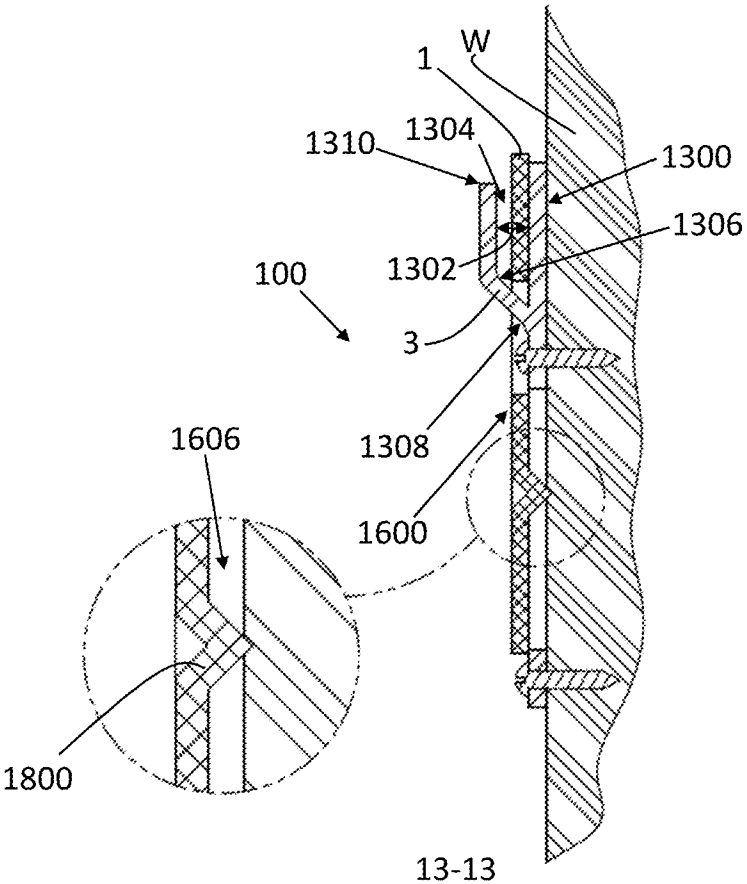
FIG. 13 depicts a cross-sectional view of the bracket/hook configuration of FIG. 12 along section line 13-13.
Figure 12:
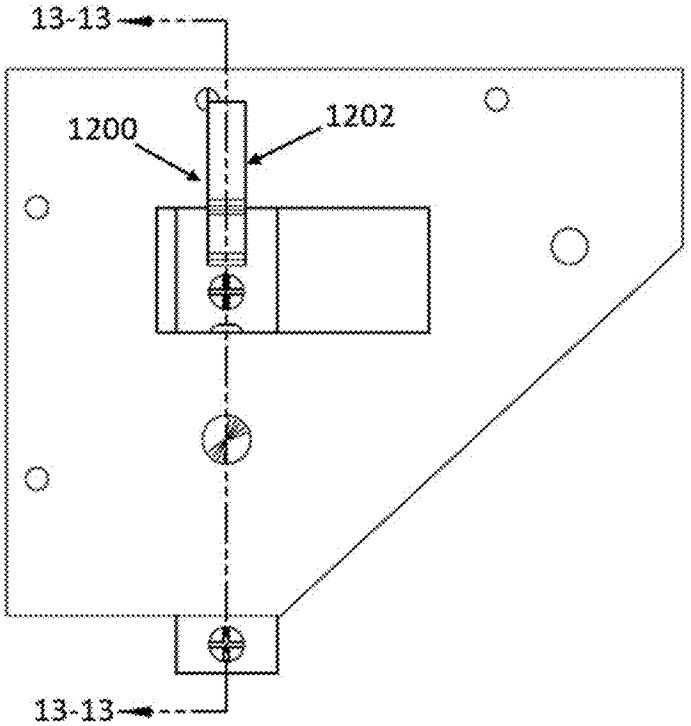
FIG. 12 depicts a back side of a bracket with a hook component removably coupled thereto in accordance with another embodiment of the present invention.
Figure 18:
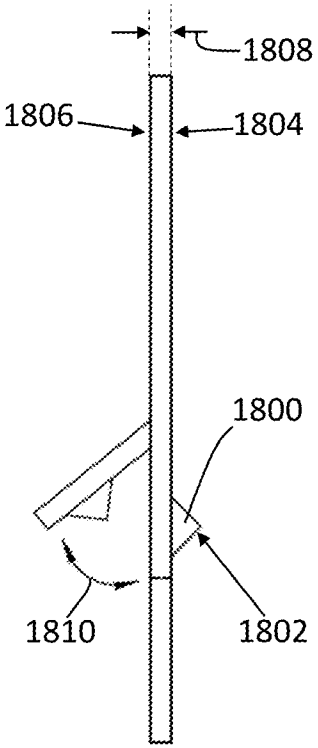
FIG. 18 depicts an elevational side view of the bracket of FIG. 17.
Figure 17:
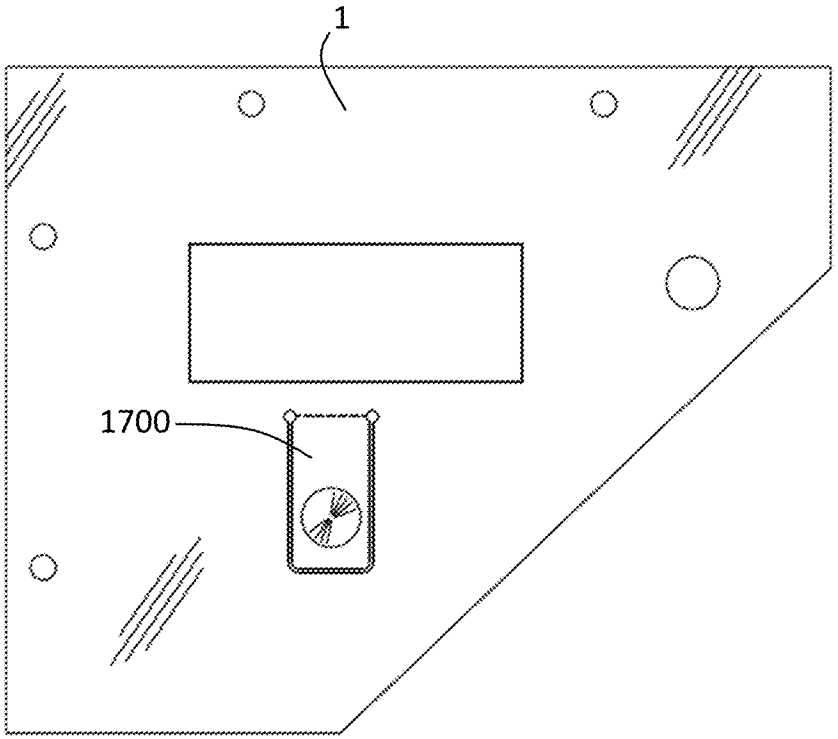
FIG. 17 depicts an elevational rear view of a bracket in accordance with one embodiment of the present invention.

As depicted in FIGS. 17-22, the bracket 1 may include various types of puncturing members 1800, 2000, 2200 coupled thereto, wherein the puncturing members 1800, 2000, 2200 include tapered ends 1802, 2002, 2202 operably configured to protrude outwardly from a rear surface 1804 of the bracket 1, as exemplified in FIG. 18. The front surface 1806 of the bracket 1 can be seen opposing the rear surface 1804, wherein a bracket thickness 1808 separates the rear and front surfaces 1804, 1806. In one embodiment, a bracket may include a tab 1700 rotatably coupled thereto. The tab 1700 may be formed, for example, with a stamping manufacturing process to create the hinge about which the tab 1700 may rotatably translate along a tab translation path (exemplified in FIG. 18 with arrow 1810). The tab 1700 may have the puncturing member 1800 directly coupled thereto. As best seen in FIGS. 12-13, the puncturing member 1800 may be configured on the bracket 1 to be aligned with the puncturing member aperture 1606. Said another way, the puncturing member aperture 1606 may be aligned with and shaped and sized to receive a portion of the tapered end of one of the puncturing members employed with a bracket 1.

Figure 20:
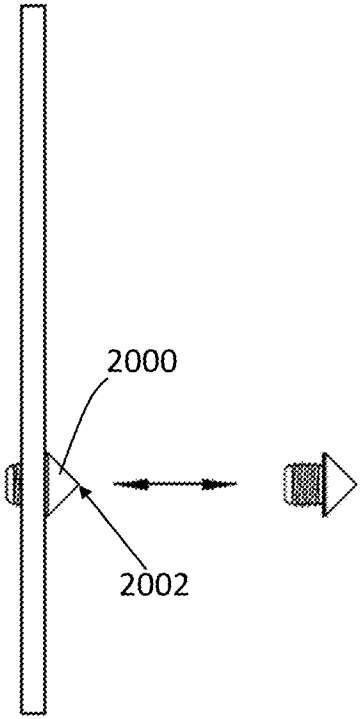
FIG. 20 depicts an elevational side view of the bracket of FIG. 19.
Figure 19:
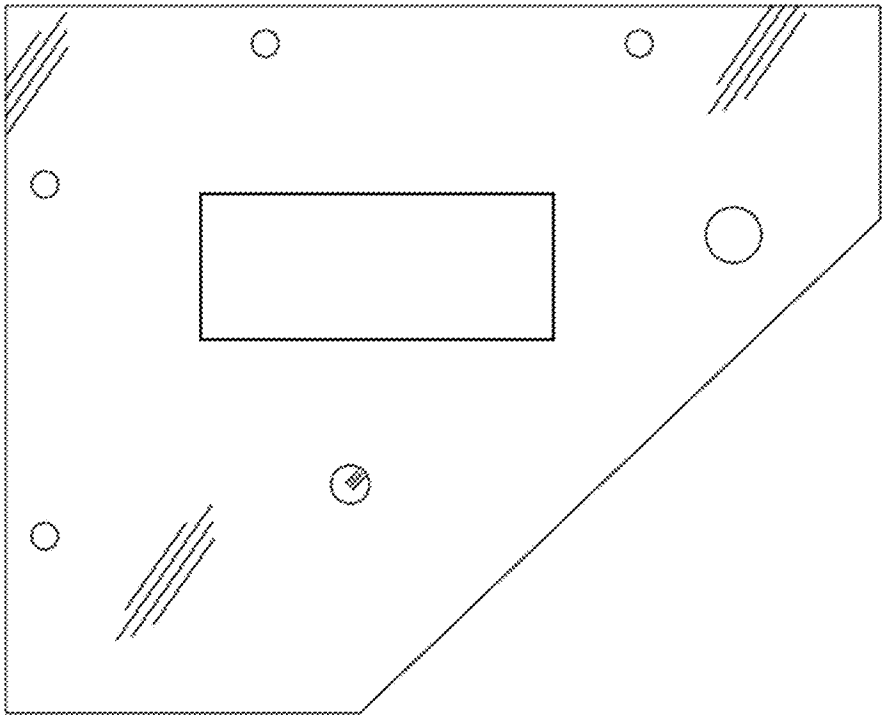
FIG. 19 depicts an elevational rear view of a bracket in accordance with one embodiment of the present invention.
Figure 22:
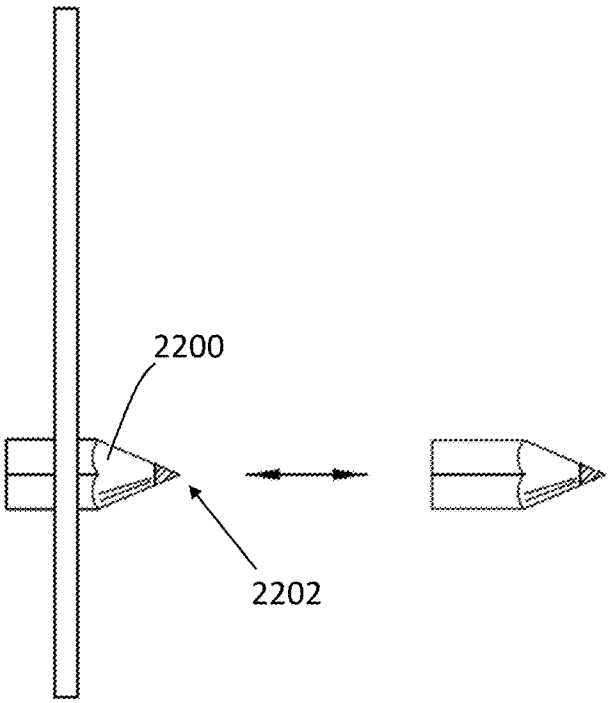
FIG. 22 depicts an elevational side view of the bracket of FIG. 21.
Figure 21:
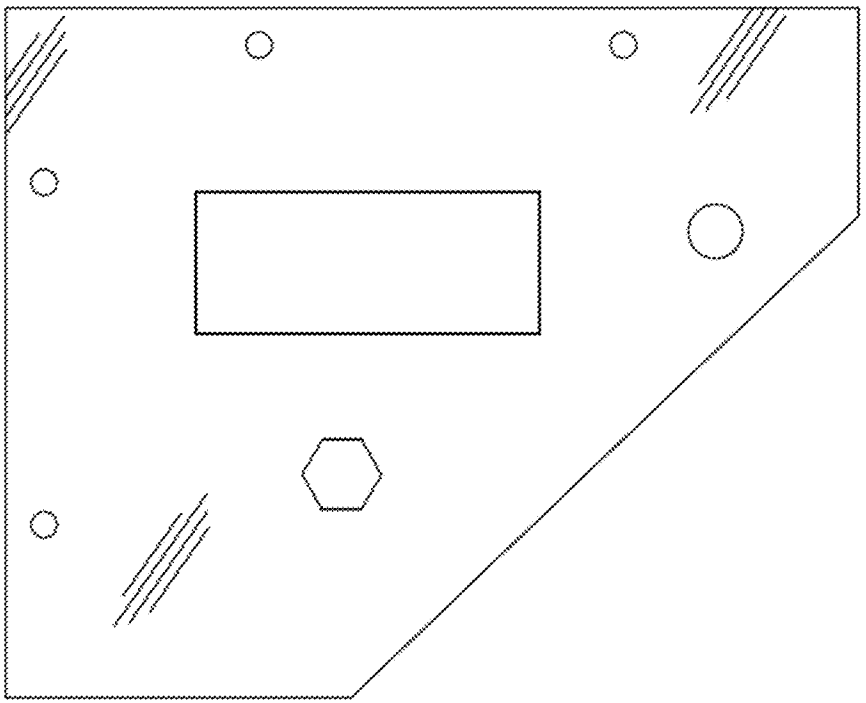
FIG. 21 depicts an elevational rear view of a bracket in accordance with one embodiment of the present invention.

With reference to FIG. 13 and FIGS. 19-22, in one embodiment, for effective installation and retention of the picture frame 8 on the building wall surface W, a puncturing member may be removably coupled to the bracket 1. In one embodiment, the puncturing member, e.g., puncturing member 2000, may be removably couplable to the bracket 1 through a tongue-and-groove configuration, while in other embodiments the coupling configuration may be through a threading configuration (as best depicted in FIGS. 19-20), e.g., a male-and-female threaded configuration. In additional embodiments, the configuration puncturing member 2200, may be removably couplable to the bracket 1 through a friction-fitting (as best depicted in FIG. 22).

Still referring to step 100 and FIGS. 2, 4*a-b*, and 14, in one embodiment, two hook components, e.g., 2*a* and 2*b* are attached on the wall surface W roughly where the picture frame 8 is going to hang. They may be attached at roughly the same height and roughly at a distance that corresponds to the distance of brackets 1 when these are attached to the rear side or surface 1400 of the picture frame 8. Also, two brackets 1*a* and 1*b* are attached to the rear side or surface 1400 of the picture frame 8 as described above. Thus, one bracket 1*a* may be attached to the upper left corner 21*a* and one bracket 1*b* may be attached to the upper right corner 21*b*.

With reference to FIGS. 1-2, FIG. 13, FIGS. 16, and 25-29, the frame hanging assembly 100 may also include a laser level assembly 2500 with a housing 2502 defining a laser emission aperture 2900. The laser level assembly 2500 enables property alignment and/or positioning of the two hook components 2*a-b*. The housing 2502 may be rotatably coupled to the hook component 2 and be disposed proximal to a lower end 1610 of the hook component 2. The laser level assembly 2500 includes a laser housed within the housing 2502 that is electrically coupled to a power source, e.g., a 6-12V lithium-ion battery. As those skilled in the art will appreciate, the laser is operably configured to emit a laser light through the laser emission aperture 2900. The laser beam (or light amplified so it can be visually perceived) may be emitted in a variety of planes desired by the user, including vertical or horizontal axes or planes that can be visually perceived by a user.

Figure 4A:
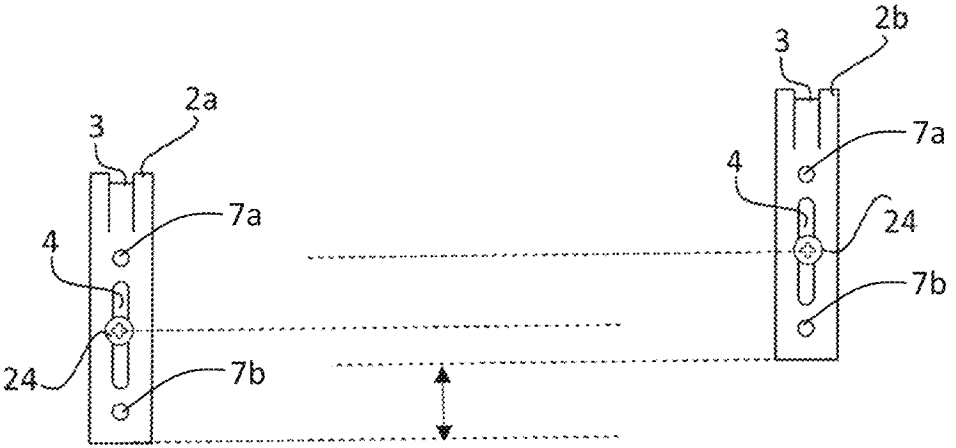
FIGS. 4*a*-4*b* depicts a wall with two hook components attached thereto, wherein FIG. 4*a* specifically depicts the hook components when initially coupled to the wall
Figure 4B:
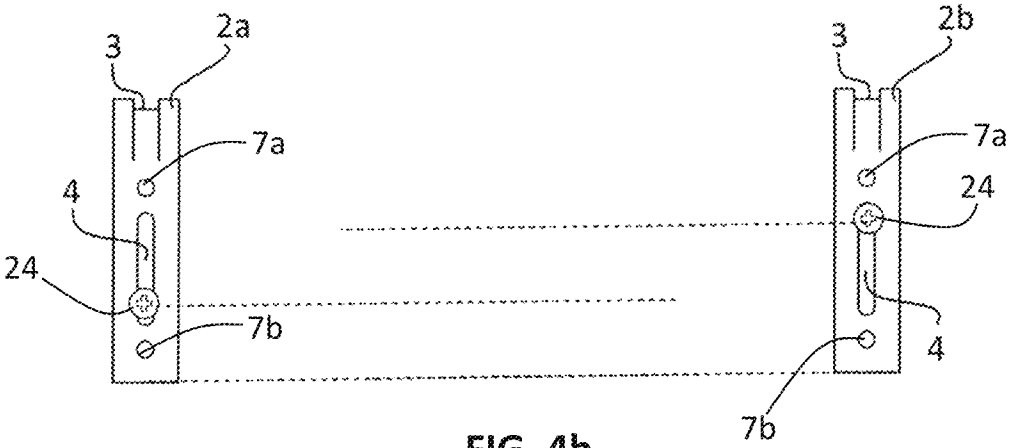

In other embodiments, step 100 may include applying a compression force on the picture frame 8 against a building wall surface W to cause the puncturing members 1800, 2000, 2200 on the brackets 1*a-d* to make at least one of marking indents and visually perceptive marking indicia on the building wall surface W. As such, the term "puncturing member" may include a structure operably configured to make a visually perceptive recess, indicia or other marking on the wall surface W, e.g., a pencil marking. In one embodiment, the user-applied compression force, e.g., 1-3 lbf, may be applied with the hook components 2*a-b* (as shown in FIGS. 4*a-b*) removably coupled to the brackets, i.e., the puncturing members would protrude through the puncturing member aperture 1606 to mark the wall surface W for hook component 2 fastening. In other embodiments, the user-applied compression force, e.g., 1-3 lbf, may be applied with the hook components 2*a-b* removed from the brackets, i.e., the user would then fasten the hook components 2 at the location marked by the puncturing members on the brackets 1. In one embodiment, the tab 1700 depicted in FIGS. 17-18 would only rotate in the translation path 1810 upon being subject to the predetermined or desired amount of compression force operable to create a torque on the tab 1700. After the marking and/or puncturing of the wall surface W, the tab 1700 may remain in a recessed position (seen in FIG. 18) along the translation path 1810 to effectuate safe and effective retention of the picture frame 8, i.e., it doesn't interfere with and/or displace the hook component 2. In other embodiments, the puncturing member may be removed from the bracket 1 or may remain on the bracket 1. Vertical positioning or leveling of the hook components 2*a-b* may again be effectuated using the laser level assemblies 2500.

With reference to FIGS. 1-3*a-b*, 5, and 13, and in step 101, the picture frame 8 is hung on the wall surface W by allowing the openings 16 of the brackets 1 to receive the hook members of the hook components such that, for example, the upper edge 17 of opening 16 engages the inner surface 1306 or inner part 23 of the hook members 3. Said another way, after the user attaches the first and second hook components 2*a-b*, using at least one fastener, to the building wall surface W, using either or both marking indents or visually perceptive marking indicia, the first and second hook components 2*a-b* have their respective rear surfaces directly coupled to the building wall surface W. Then the user inserts the terminal end 1310 of the cantilever hook member 3 of the first and second hook components 2*a-b* in the hook-receiving apertures 16 of the first and second brackets 1*a-b*, respectively. As such, the first and second brackets 1*a-b* are placed within the bracket placement zone of the first and second hook components 2*a-b*, respectively, and rest in a leveling orientation on the inner surfaces 1306 of the hook members 3 of the first and second hook components 2*a-b*, respectively, thereby displaying the picture frame 8 on the building wall surface W.

With reference back to FIGS. 1-3, FIGS. 13, and 25-29, the picture frame 8 may be checked to see if it hangs straight and at the desired height. Again, the laser level assemblies 2500 on the hook components 2 may beneficially facilitate in ascertaining the correct position of the hook components 2. If the frame 8 does not hang straight or at the desired height, the picture frame 8 is removed from the hook components 3. The hook components 2*a-b* may be adjusted vertically or horizontally (if not fastened to the wall) in step 103 depending on the desired position. Adjustment can for example take place by moving the elongated hole 4 in relation to a screw 24 in the wall. One or both of hook components 2*a-b* may be adjusted. Said differently, one hook component 2*a* may be adjusted upwards and the other hook component 2*b* may be adjusted downwards, if the picture frame is not leveled. Additionally, adjustment may occur horizontally by laterally adjusting the picture frame 8 by sliding the first and second brackets 1*a-b* in a coplanar transverse direction on the inner surfaces 1306 of the hook members 3 of the first and second hook components 2*a-b*.

FIG. 4*a* show how the hook components 2 have been provisionally fastened on the wall surface W so that the hook members 3 are not placed in the relative height position. The arrow indicates the error. The rather large error makes it necessary to vertically adjust both hook elements 2*a-b*, such that hook component 2*a* is moved upward and hook element 2*b* is moved downward. The result is shown in FIG. 4*b* where the hook components 2*a-b* are the same relative height or level. Thus, when the vertical adjustment of "x" inches is possible for one single hook component 2 (x is for example the length of elongated hole 4), the total possible relative adjustment for the two hooks is 2x.

With reference to FIGS. 1-3, the process may proceed to the step of hanging the picture frame 8 on the hook components 2*a-b* again (step 101) and 102 and 103 are repeated, if necessary, until the picture frame 8 hangs at a level position and at the desired height. When the correct height of both hook components 2*a-b* has been found, a non-vertically adjustable attachment apertures 7*a-b* can be used for securing the hook components 2*a-b* at the correct height. When the picture frame 8 hangs level and at the desired height, it may also be adjusted horizontally in step 104 to the desired position by sliding the upper edge 17 of opening 16 along the hooks 3.

While not depicted in the figures, the picture frame hanging system 100 may comprise a locking mechanism assembly for locking the picture frame 8 to the hook component 2. Beneficially, this locking engagement prevents theft of the picture 8. For example, the one or more bracket(s) 1*a-n* are mechanically coupled to the frame 8 using fasteners, wherein a wire, e.g., a metal wire, may be coupled to the one or more bracket(s) bracket(s) 1*a-n* by inserting the wire into an aperture of the bracket(s) 1*a-n*. In this manner, the picture frame 8 can be secured to the hook component 2 which is attached to the wall surface W.

Figure 9:
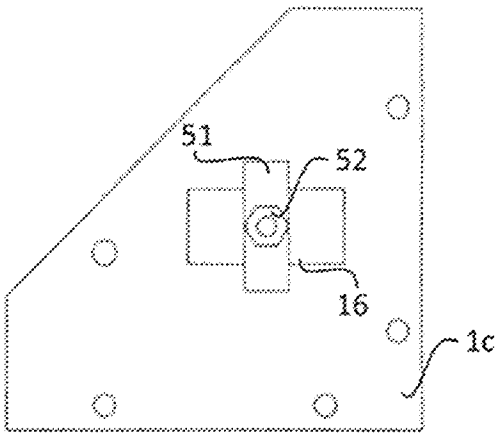
Figure 8:
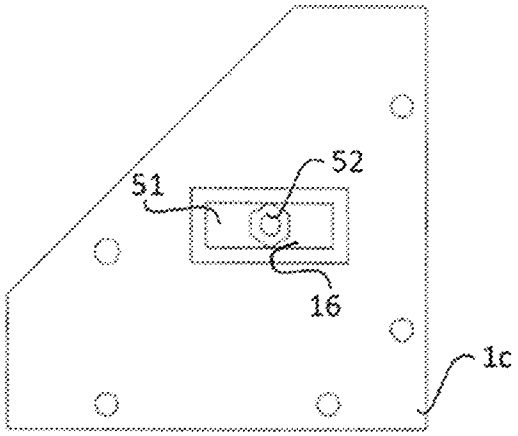
Figure 11:
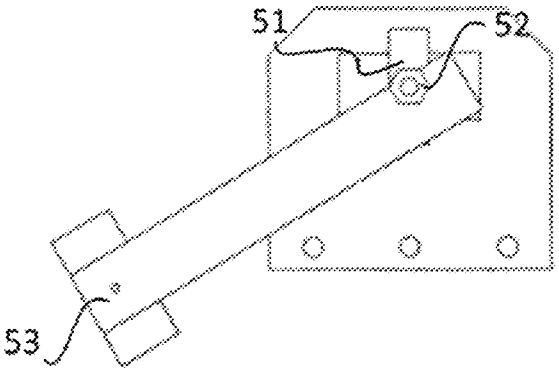
Figure 10:
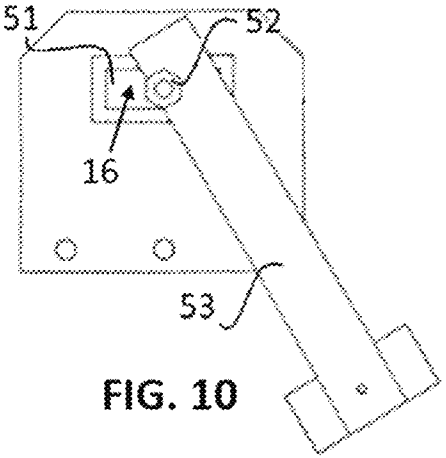

An alternative locking mechanism is shown in FIGS. 6-11, where four brackets 1*a-d* are fastened to the rear side of the picture frame 8, one in each corner. In this embodiment, the system 100 may include at least three brackets 1*a-d* and one or more locking screw(s) 50. The screw 50 has a wall fastening means and may comprise a locking member 51, wherein said locking member 51 is operably configured to engage a part of a bracket 1*a-d*, e.g., opening 16, in a locking manner. One of the lower brackets 1*c-d* may be used for locking the picture frame 8 to the locking screw 50 which is be screwed into the wall surface W, preferably with the aid of a bolt 52 fastened to screw 50. The locking screw 50 has locking member 51 that is able to engage with the opening 16 of the bracket 1*c-d* in a locking manner. The locking member 51 turns with screw 50 and bolt 52. The locking member 51 may be such that the picture frame 8 is locked to the screw 50 in the wall surface W in at least one angular position of the screw 50 and unlocked from the screw 50 in at least one angular position of the screw 50. For example, the locking member 51 may have a shape such that it will be able to pass through the opening 16 in one angular position of the screw 50 (FIG. 8) but unable to pass through the opening 16 when the locking screw 50 has been turned to another angular position (FIG. 9). Preferably the shape of locking member 51 is an oblong shape, such as in FIGS. 8-11 the bolt 52 can be reached from behind the picture frame 8 with means of tool 53, depicted in FIGS. 10-11.

Figure 23:
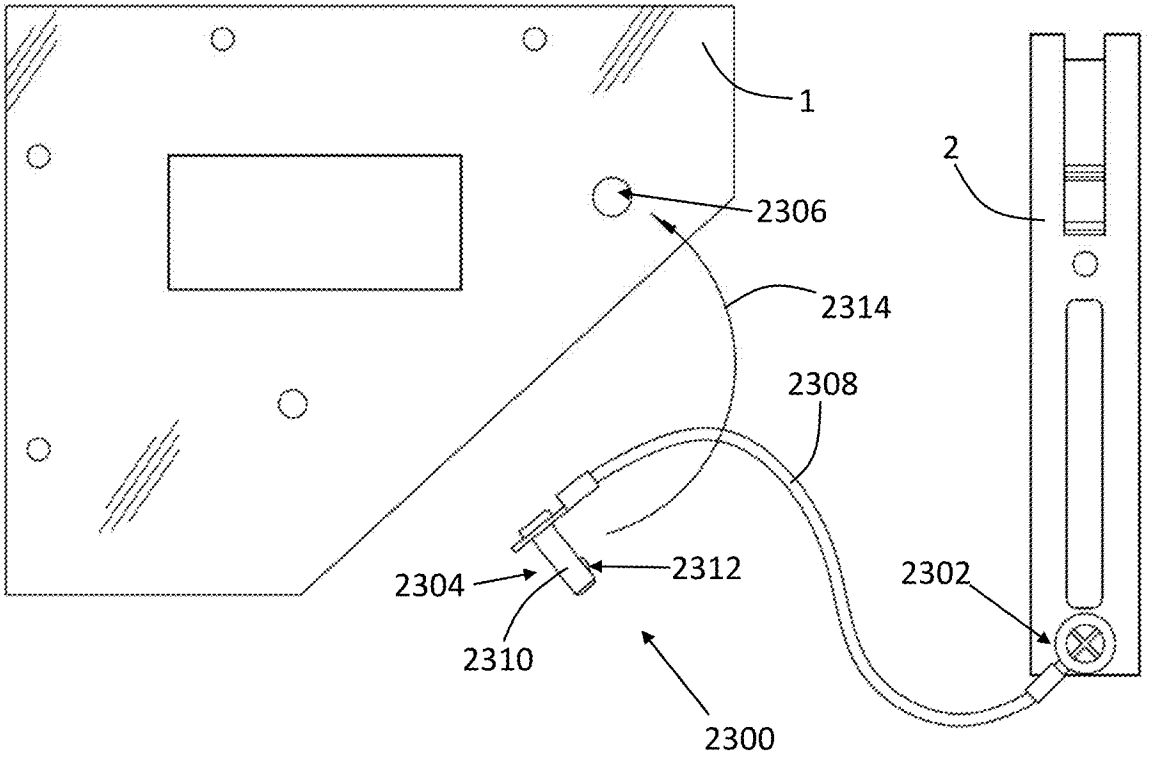
FIG. 23 depicts an exploded view of a bracket and hook configuration in accordance with one embodiment of the present invention.
Figure 24:
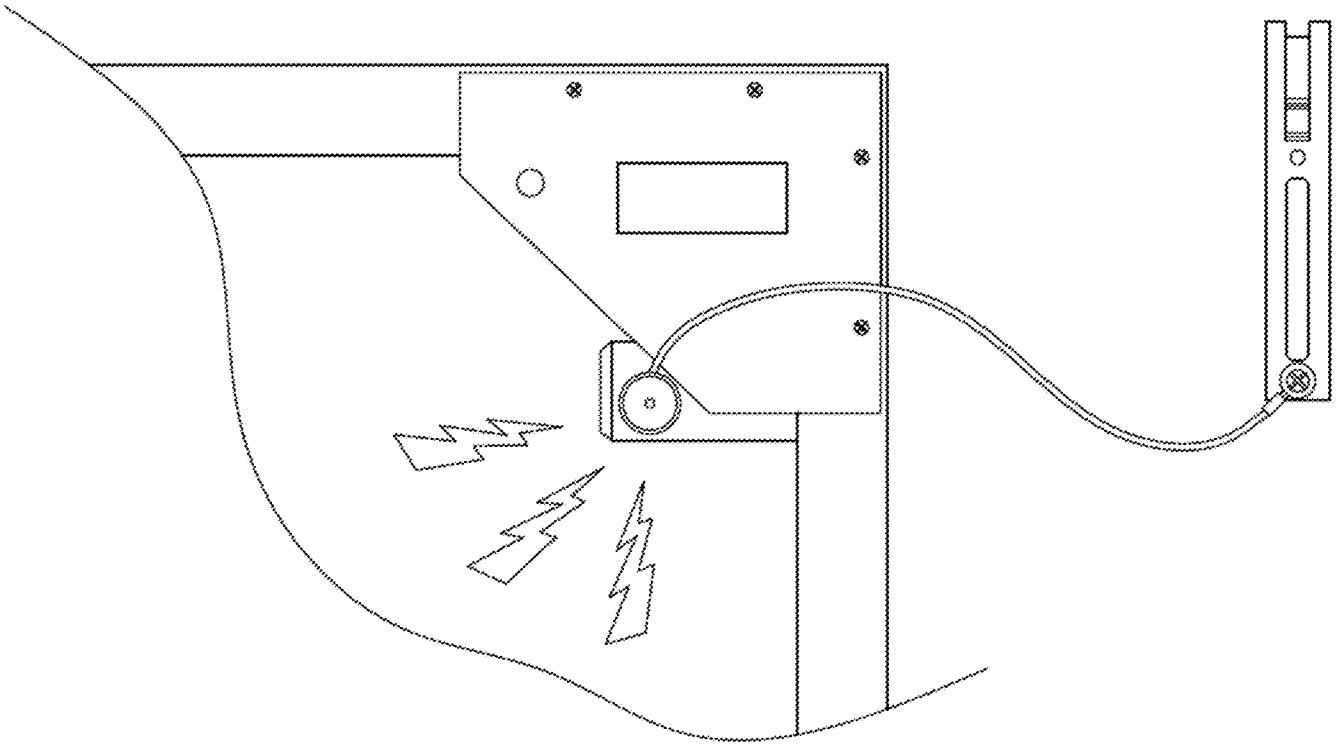
FIG. 24 depicts an exploded view of a bracket and hook configuration in accordance with one embodiment of the present invention.
Figure 29:
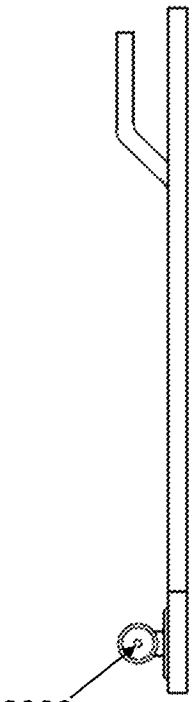
FIG. 29 depicts an elevational side view of the hook component of FIG. 25 with the leveling device in another orientation.
Figure 27:
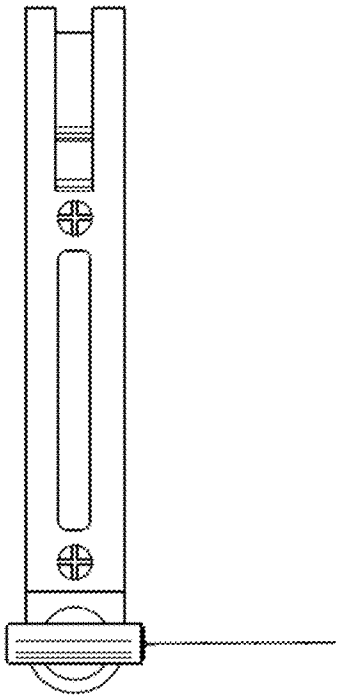
FIG. 27 depicts an elevational front view of the hook component of FIG. 25 with the leveling device in another orientation.
Figure 28:
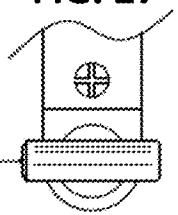
FIG. 28 depicts an elevational fragmentary front view of the hook component of FIG. 25 with the leveling device in another orientation.
Figure 26:
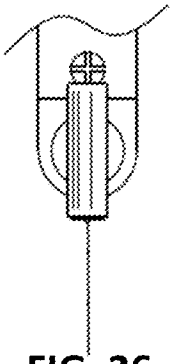
FIG. 26 depicts an elevational fragmentary front view of the hook component of FIG. 25 with the leveling device in another orientation.
Figure 25:
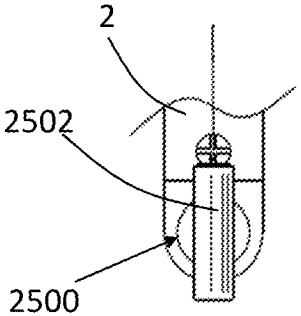
FIG. 25 depicts an elevational fragmentary front view of a hook component employed in accordance with one embodiment of the present invention.

In yet other embodiments, as depicted in FIGS. 23-24, the frame hanging assembly 100 may include a frame retention assembly 2300 having a first end 2302 directly and removably coupled to the hook component 2 with, for example, a fastener. The frame retention assembly 2300 may include a second end 2304 directly and removably coupled to the bracket 1 having a security aperture 2306 defined thereon. Those of skill in the art will appreciate that the first end 2302 may be directly and removably coupled to the bracket 1 with the other end 2304 coupled to hook component 2. The frame retention assembly 2300 may include a security tether 2308, e.g., metal wire, separating the first and second ends 2302, 2304 of the frame retention assembly 2300, wherein the second end 2304 includes a rigid security arm 2310 with a detent 2312 disposed thereon. The rigid security arm 2310 is shaped and sized to be received within the security aperture 2306 with depression of the detent 2312. An exemplary coupling path of the second end 2304 and the bracket 1 is depicted with arrow 2314. In one embodiment, the removal of the detent 2312 and/or arm 2310 and/or cutting of tether 2308 may activate an auditory signal with an electrically powered transducer, e.g., speaker, signaling a potential theft or removal of the picture frame (represented in FIG. 24). In one embodiment, evidence of removal may be effectuated through a sensor. In another embodiment, evidence of removal may be effectuated through an electrical switch. In further embodiments, the removal may effectuate transmittal of a signal, over a network, to one or more user's computing device via a network interface.

Figure 5:
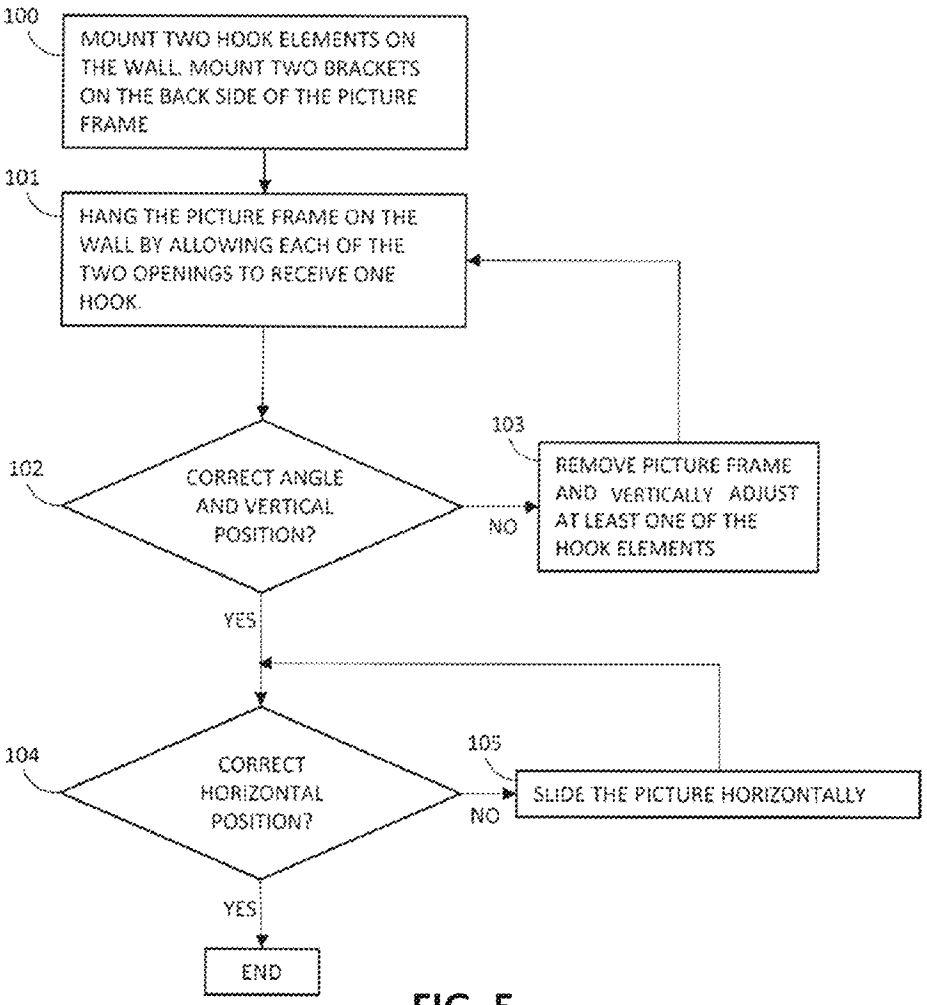
FIG. 5 is a process flow chart illustrating an exemplary method hanging a picture frame.
Figure 7:
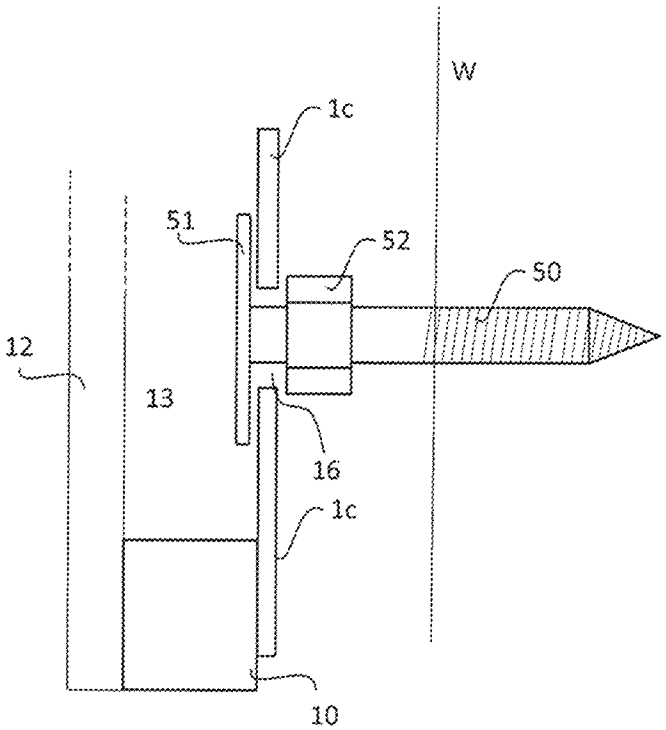
FIGS. 6-11 depicts an exemplary locking mechanism in accordance with one embodiment of the present invention.
Figure 6:
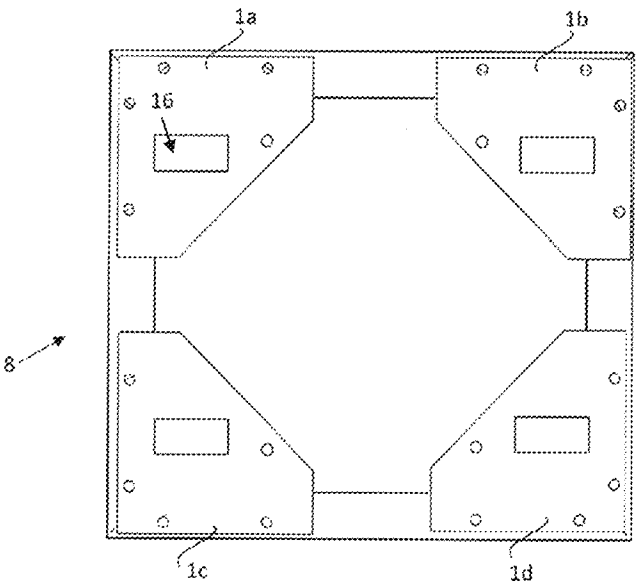

Many of the figures depicted have been described in conjunction with the process flow chart of FIG. 5. Although FIG. 5 shows a specific order of executing the process steps, the order of executing the steps may be changed relative to the order shown in certain embodiments. Also, two or more blocks shown in succession may be executed concurrently or with partial concurrence in some embodiments. Certain steps may also be omitted in FIG. 5 for the sake of brevity. In some embodiments, some or all of the process steps included in FIG. 5 may be combined into a single process.

Figure 31:
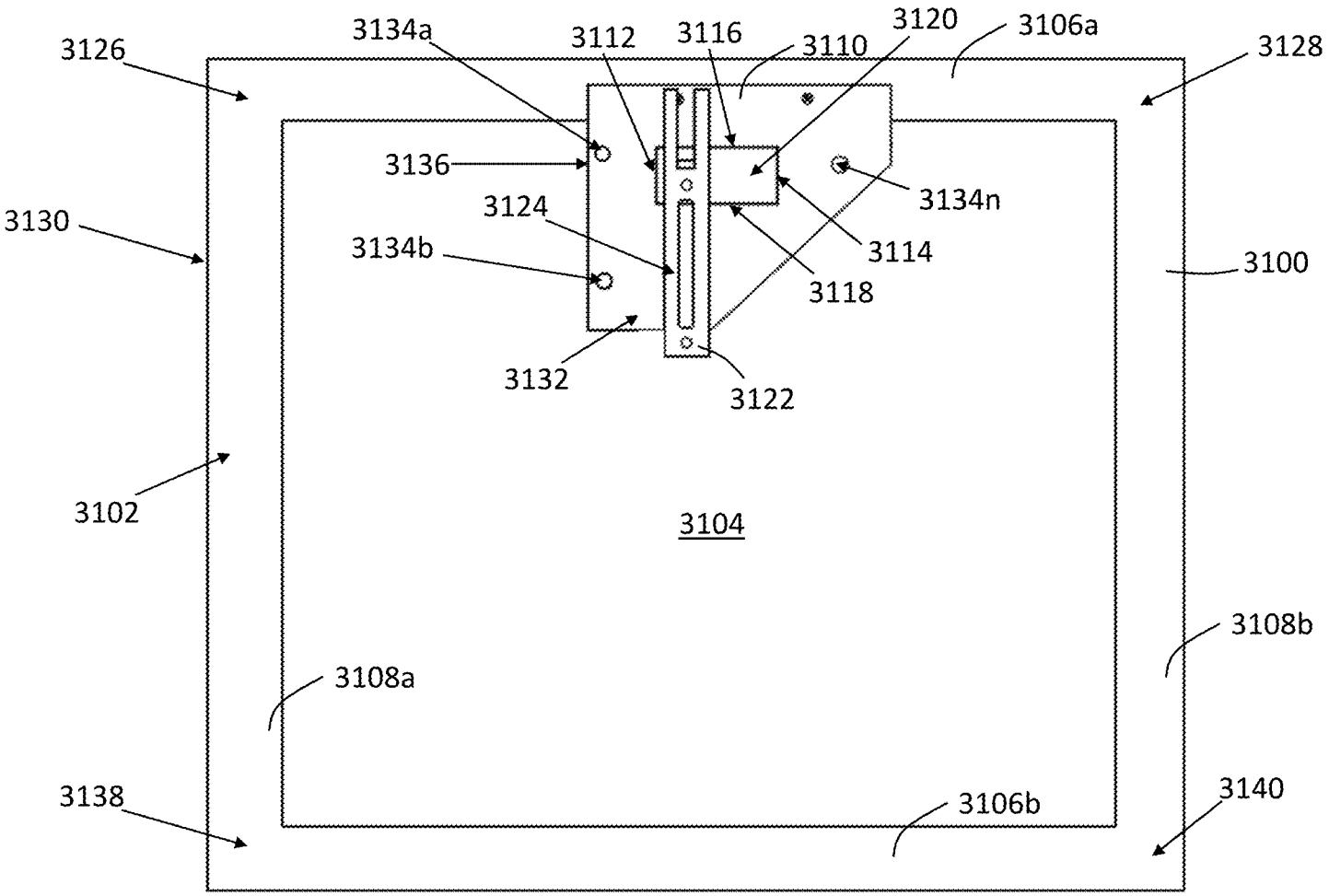
FIG. 31 depicts a back side of a picture frame with another bracket and a hook component coupled thereto in accordance with one embodiment of the present invention.
Figure 32:
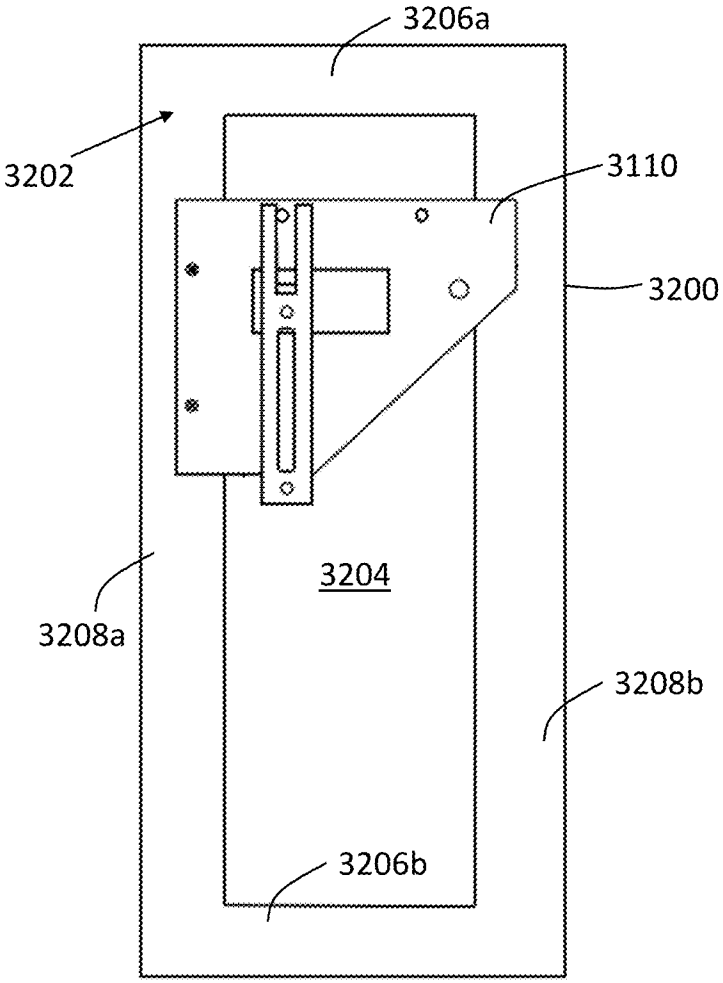
FIG. 32 depicts a back side of another picture frame with the bracket and the hook component of FIG. 31 coupled thereto in accordance with one embodiment of the present invention.

With reference to FIGS. 31-32 and as discussed above, only a single bracket 3110 may be utilized to support a picture frame 3100, 3200 having a front surface, a rear surface 3102, 3202 opposing the front surface, defining an enclosed frame cavity 3104, 3204 on the rear surface 3102, 3202 of the picture frame 3100, 3200. The picture frame 3100, 3200 may have respective horizontally oriented frame elements 3106*a-b*, 3206*a-b* opposing one another, and respective vertically oriented frame elements 3108*a-b*, 3208*a-b* opposing one another and that that separate the horizontally oriented frame elements 3106*a-b*. The frame elements define two opposing upper corner joints 3126, 3128 and two opposing lower corner joints 3138, 3140 defined by one of the horizontally oriented frame elements and one of the vertically oriented frame elements.

The at least one bracket 3110 may be directly coupled to at least one of the horizontally and vertically oriented frame elements 3106*a-b*, 3108*a-b*, i.e., a bracket 3110 may be coupled to just the horizontal frame element 3106*a*, the horizontal frame element 3106*a* and one of the vertical frame elements 3108*a-b*, or just one of the vertical frame elements 3108*a-b*. The picture frame 3100 may include two opposing upper corner joints 3126, 3128 defined by one of the horizontally oriented frame elements 3106*a-b* and one of the vertically oriented frame elements 3108*a-b*. In one embodiment, the least one bracket 3110 is interposed medially between the two opposing upper corner joints 3126, 3128. In another embodiment (as best seen in FIG. 32), the at least one bracket 3110 may directly couple to one of the vertically oriented frame elements (e.g., frame element 3208*a*) using one or more fastener(s) and extend into the frame cavity 3204 a distance through the medial axis or center of the frame 3200. The bracket 3110 in FIG. 32 may be couplable to a frame 3200 that is relatively narrow or the dimensions of the bracket 3110 may be increased to extend across the rear surface 3202 of the frame 3200. As seen in FIG. 2 and FIG. 31, the bracket 3110 may also beneficially include a plurality of fastening apertures 5*a*, 6*a* spaced apart from one another and disposed proximal to a perimeter edge (e.g., edge 3136), thereby providing versatility in coupling the bracket 3110 to the frame 3100. The plurality of fastening apertures may be beneficially defined proximal (e.g., at or near—within 10% of the overall length) to the upper perimeter edge or side perimeter edge (as best shown in FIG. 31). One or more security apertures 22, 3134*a-n*, which may, in some embodiments also be utilized for mounting the bracket 3110, may also be defined on the bracket 3110 that are utilized as discussed herein.

As discussed above, the bracket 3110 may enclose and define, with two internal sidewalls 3112, 3114, an upper wall 3116 linearly extending to and from the two internal sidewalls 3112, 3114, and an internal bottom wall 3118, a hook-receiving aperture 3120 superimposed over the frame cavity 3104, 3204 and may have an aperture width separating the two internal sidewalls 3112, 3114. Still referring to FIG. 31 in combination with FIG. 13, at least one hook component 3122 is utilized with the bracket 3110 and has a rear surface 3124 directly coupled to a building wall surface W and a front surface, opposing the rear surface 3124 of the hook component 3122, with a cantilevered hook member 3 extending therefrom an offset length from the front surface of the hook component 3122 to define a bracket placement zone with the at least one bracket disposed therein and having an inner surface 1306. The hook component 3122 includes an inner surface hook width spanning from terminal opposing lateral sides of the hook member 3, at least partially supporting the linear upper wall of the at least one bracket 3110, wherein the aperture width is at least approximately twice or greater than the inner surface hook width and with the cantilevered hook member 3 disposed through the hook-receiving aperture, thereby providing lateral adjustment of the picture frame 3100.

As such, a single bracket 3110 and single hook component 3122 may be utilized to couple and adjust a frame with respect to a wall surface effectively and safely. In one embodiment, the horizontally oriented and vertically oriented frame elements 3106*a-b*, 3108*a-b* collectively define a picture frame perimeter 3130 that defines a frame area, wherein the at least one bracket 3110 and the at least one hook component 3122 are completely disposed within the frame area (thereby not being visible when viewing the frame from the front).

As such, a frame hanging assembly has been disclosed that enables quick, effective, and safe installation and retention of picture frames, among other similar devices, by a user.

What is claimed is:

1. In combination with a picture frame having a front surface, a rear surface opposing the front surface, defining an enclosed frame cavity on the rear surface of the picture frame, having horizontally oriented frame elements opposing one another, and having vertically oriented frame elements opposing one another and each respectively separating the horizontally oriented frame elements, an improvement comprising:

at least one bracket directly coupled to at least one of the horizontally and vertically oriented frame elements and enclosing and defining, with two internal sidewalls, an upper wall linearly extending to and from the two internal sidewalls, and an internal bottom wall, a hook-receiving aperture superimposed over the frame cavity and with an aperture width separating the two internal sidewalls; and at least one hook component having a rear surface directly coupled to a building wall surface and a front surface, opposing the rear surface of the hook component, with a cantilevered hook member extending therefrom an offset length from the front surface of the hook component to define a bracket placement zone with the at least one bracket disposed therein and having an inner surface, an inner surface hook width spanning from terminal opposing lateral sides of the hook member, at least partially supporting the linear upper wall of the at least one bracket, the aperture width at least approximately twice or greater than the inner surface hook width and with the cantilevered hook member disposed through the hook-receiving aperture, thereby providing lateral adjustment of the picture frame.

2. The improvement according to claim 1, the picture frame including two opposing upper corner joints defined by one of the horizontally oriented frame elements and one of the vertically oriented frame elements, wherein:

the least one bracket is interposed medially between the two opposing upper corner joints.

3. The improvement according to claim 2, wherein:

the least one bracket and the least one hook component are of a plate-like shape and substantially rigid.

4. The improvement according to claim 2, wherein:

the hook-receiving aperture is elongated in the transverse direction.

5. The improvement according to claim 4, wherein:

the cantilevered hook member is at least partially disposed within the enclosed frame cavity.

6. The improvement according to claim 1, wherein the at least one hook component further comprises:

an upper end and a lower end opposing the upper end, wherein a terminal end of the hook member of each of the hook components is disposed proximal to the upper end of the hook component.

7. The improvement according to claim 6, the horizontally oriented and vertically oriented frame elements collectively define a picture frame perimeter that defines a frame area, wherein:

the at least one bracket and the at least one hook component are completely disposed within the frame area.

8. The improvement according to claim 1, wherein the at least one bracket has a rear surface, a front surface opposing the rear surface, and further comprising:

a puncturing member coupled thereto and with a tapered end operably configured to protrude outwardly from the rear surface of the at least one bracket.

9. The improvement according to claim 8, wherein the at least one hook component further comprises:

a puncturing member aperture aligned with and shaped and sized to receive the tapered end of the puncturing member.

10. The improvement according to claim 8, wherein the at least one bracket further comprises:

a tab rotatably coupled thereto and having the puncturing member coupled thereto.

11. The improvement according to claim 1, wherein the at least one bracket further comprises:

a plurality of fastening apertures spaced apart from one another and disposed proximal to a perimeter edge.

12. In combination with a picture frame having a front surface, a rear surface opposing the front surface, defining an enclosed frame cavity on the rear surface of the picture frame, having horizontally oriented frame elements opposing one another, having vertically oriented frame elements opposing one another and each respectively separating the horizontally oriented frame elements, and having two opposing upper corner joints and two opposing lower corner joints defined by one of the horizontally oriented frame elements and one of the vertically oriented frame elements, an improvement comprising:

at least one bracket interposed between either the two opposing upper corner joints and directly coupled to at least one of the horizontally and vertically oriented frame elements or interposed between one of the two opposing upper corner joints and one of the two opposing lower corner joints and directly coupled to one of the vertically oriented frame elements, and enclosing and defining a hook-receiving aperture superimposed over the frame cavity and with an aperture width; and at least one hook component having a rear surface directly coupled to a building wall surface and a front surface, opposing the rear surface of the hook component, with a cantilevered hook member extending therefrom an offset length from the front surface of the hook component to define a bracket placement zone with the at least one bracket disposed therein and having an inner surface, with an inner surface hook width spanning from terminal opposing lateral sides of the hook member, at least partially supporting an upper wall of the at least one bracket, the aperture width at least approximately twice or greater than the inner surface hook width.

13. The improvement according to claim 12, wherein:

the at least one bracket is interposed medially between either the two opposing upper corner joints or between the one of the two opposing upper corner joints and the one of the two opposing lower corner joints.

14. The improvement according to claim 12, wherein the at least one bracket further comprises:

two internal sidewalls, an upper wall linearly extending to and from the two internal sidewalls, and an internal bottom wall, the hook component having an inner surface with an inner surface hook width spanning from terminal opposing lateral sides of the hook member, and at least partially supporting the linear upper wall of the at least one bracket, the cantilevered hook member of the at least one hook component disposed through the hook-receiving aperture, thereby providing lateral adjustment of the picture frame.

15. The improvement according to claim 14, wherein the at least one bracket has a rear surface, a front surface opposing the rear surface, and further comprises:

a puncturing member coupled thereto and with a tapered end operably configured to protrude outwardly from the rear surface of the bracket, the at least one hook component further comprising a puncturing member aperture aligned with and shaped and sized to receive the tapered end of the puncturing member.

* * * * *